US011597617B2

(12) United States Patent
Namiki et al.

(10) Patent No.: US 11,597,617 B2
(45) Date of Patent: Mar. 7, 2023

(54) MEDIUM FEEDING APPARATUS, IMAGE READING APPARATUS, AND MEDIUM FEEDING METHOD

(71) Applicant: SEIKO EPSON CORPORATION, Tokyo (JP)

(72) Inventors: Masaki Namiki, Fukutsu (JP); Kiyotaka Nakamura, Kitakyushu (JP); Takayuki Shiota, Kitakyushu (JP); Yohei Miyagi, Kitakyushu (JP); Katsuhiko Nishizaka, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 16/554,251

(22) Filed: Aug. 28, 2019

(65) Prior Publication Data

US 2020/0071100 A1 Mar. 5, 2020

(30) Foreign Application Priority Data

Aug. 29, 2018 (JP) ..... JP2018-160628
Feb. 28, 2019 (JP) ..... JP2019-036493

(51) Int. Cl.
*B65H 3/06* (2006.01)
*B65H 7/18* (2006.01)
*B65H 5/06* (2006.01)

(52) U.S. Cl.
CPC ..... *B65H 3/0669* (2013.01); *B65H 3/0607* (2013.01); *B65H 5/062* (2013.01); *B65H 7/18* (2013.01); *B65H 2515/32* (2013.01)

(58) Field of Classification Search
CPC .. B65H 3/0669; B65H 3/0607; B65H 3/0684; B65H 5/062; B65H 7/18; B65H 2515/32
See application file for complete search history.

(56) References Cited

U.S. PATENT DOCUMENTS 5,669,601 A * 9/1997 Fisher ..... B65H 1/266 271/117
6,953,190 B2 * 10/2005 Shin ..... B65H 1/12 271/157
7,007,945 B2 * 3/2006 Hiramitsu ..... B65H 3/0623 271/122

(Continued)

FOREIGN PATENT DOCUMENTS

JP H07-179237 7/1995
JP 2003-176052 6/2003

(Continued)

*Primary Examiner* — Thomas A Morrison
(74) *Attorney, Agent, or Firm* — Workman Nydegger

(57) ABSTRACT

A medium feeding apparatus includes a feed roller that feeds media. A separation roller nips the media together with the feed roller to separate it and is rotated in a first direction to feed the media. A motor applies driving torque to the separation roller in a second direction opposite to the first direction. A torque limiter, when rotation torque applied to the separation roller in the first direction exceeds a preset upper torque limit, causes the separation roller to rotate at idle in the first direction independently of the driving torque. During feeding operations, including feeding of first and second media, a controller that controls the motor provides a break period in which the motor is not driven. The break period contains the timing when a rear edge of the first medium leaves a nip position between the feeding and separation rollers.

12 Claims, 22 Drawing Sheets

(56) References Cited

U.S. PATENT DOCUMENTS

| | | | | |
|---|---|---|---|---|
| 8,011,651 | B2 * | 9/2011 | Morita | B65H 5/062 271/10.03 |
| 8,302,956 | B2 * | 11/2012 | Matsushima | B65H 3/50 271/114 |
| 2003/0063337 | A1 | 4/2003 | Shirai et al. | |
| 2006/0203308 | A1 | 9/2006 | Shirai et al. | |
| 2010/0148423 | A1 | 6/2010 | Morita et al. | |
| 2012/0113488 | A1 * | 5/2012 | Machida | B65H 3/56 358/498 |
| 2012/0287454 | A1 * | 11/2012 | Arimura | H04N 1/00628 358/1.13 |
| 2013/0234387 | A1 | 9/2013 | Moto | |
| 2015/0210493 | A1 * | 7/2015 | Tanaka | B65H 3/5261 271/225 |
| 2016/0251179 | A1 | 9/2016 | Kuriki | |
| 2018/0029815 | A1 | 2/2018 | Yonemura | |

FOREIGN PATENT DOCUMENTS

| | | |
|---|---|---|
| JP | 2010-143695 | 7/2010 |
| JP | 2012-188279 | 10/2012 |
| JP | 2013-184819 | 9/2013 |
| JP | 2016-159988 | 9/2016 |
| JP | 2018-016483 | 2/2018 |

* cited by examiner

MEDIUM FEEDING APPARATUS, IMAGE READING APPARATUS, AND MEDIUM FEEDING METHOD

The present application is based on, and claims priority from JP Application Serial Number 2018-160628, filed Aug. 29, 2018 and JP Application Serial Number 2019-036493, filed Feb. 28, 2019, the disclosures of which are hereby incorporated by reference herein in their entirety.

BACKGROUND

1. Technical Field

The present disclosure relates to a medium feeding apparatus that feeds media, an image reading apparatus with the medium feeding apparatus, and a medium feeding method.

2. Related Art

Some scanners, which are one example of image reading apparatuses, have sheet feeders that automatically feed and read a plurality of sheets or media. Such sheet feeders are sometimes referred to as auto document feeders (ADFs).

A sheet feeder includes: a sheet tray that has a mounting surface on which a plurality of sheets are to be mounted; and a feed roller and a separation roller disposed in contact with each other. The feed roller rotates in the forward direction while being in contact with the sheets on the sheet tray, thereby feeding them. The separation roller separates one of those sheets from the others.

When separating the sheets, the separation roller rotates in the reverse direction so that the one sheet is fed and the others are returned toward the sheet tray. Such separation rollers can be classified into two types: an active type and an inactive type. A separation roller of the active type rotates by means of a driving torque transmitted from a motor via a torque limiter, whereas a separation roller of the inactive type rotates by means of rotational resistance of a torque limiter. JP-A-2013-184819 discloses one example of medium feeding apparatuses which has separation rollers of active and inactive types. In this document, the separation rollers are called brake rollers.

Image reading apparatuses as described above have some disadvantages. When the front edge of a sheet enters into the nip position between the separation roller and the feed roller, both the separation roller and the feed roller are deformed, because they are each made of an elastic material. Then, when the rear edge of the sheet leaves the nip position, the separation roller and the feed roller return to their original shapes. As this time, the next sheet on the separation roller is pushed back to the upstream side. In other words, a so-called "kickback phenomenon" occurs. If the separation roller is of the active type, this separation roller may rotate in the reverse direction, in which case the rotational force acts on the front edge of the next sheet on the separation roller.

As described above, when the rear edge of a sheet leaves the nip position, both opposite force generated by the above kickback phenomenon and opposite force generated by the reverse rotation of the separation roller are applied at one time to the front edge of the next sheet on the separation roller. As a result, a front portion of this sheet may be curled up and fail to smoothly enter into the nip position. In which case, the sheet may be stuck between the separation roller and the feed roller.

SUMMARY

According to an aspect of the present disclosure, a medium feeding apparatus includes a feed roller that feeds a plurality of media. A separation roller nips the media together with the feed roller to separate the media and is rotated in a first rotation direction to feed the media to a downstream side in a feeding direction. A motor applies driving torque to the separation roller in a second rotation direction that is opposite to the first rotation direction. A torque limiter that, when rotation torque applied to the separation roller in the first rotation direction exceeds a preset upper torque limit, causes the separation roller to rotate at idle in the first rotation direction independently of the driving torque. A controller controls the motor. During feeding operations, including an operation of feeding a first medium and a second medium in this order, the controller provides a break period in which the motor is not driven. The break period contains a timing at which a rear edge of the first medium leaves a nip position between the feed roller and the separation roller.

DESCRIPTION OF EXEMPLARY EMBODIMENTS

Figure 1:
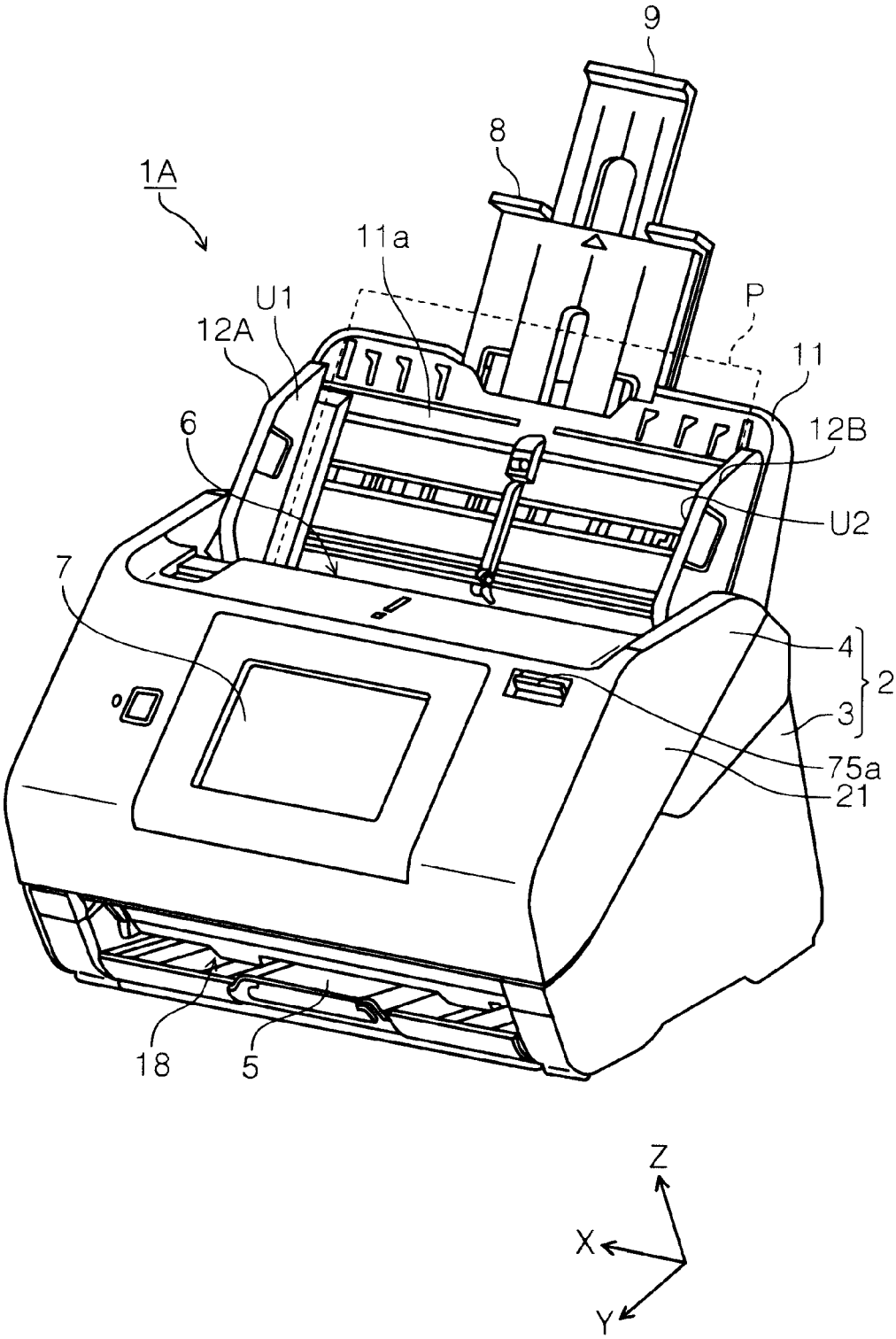
FIG. 1 is a perspective view of a scanner, which is an example of an image reading apparatus according to an embodiment of the present disclosure.

Some aspects of the present disclosure will be described briefly below. According to a first aspect, a medium feeding apparatus includes a feed roller that feeds a plurality of media. A separation roller nips the media together with the feed roller to separate the media and is rotated in a first rotation direction to feed the media to a downstream side in a feeding direction. A motor applies driving torque to the separation roller in a second rotation direction that is opposite to the first rotation direction. A torque limiter, when rotation torque applied to the separation roller in the first rotation direction exceeds a preset upper torque limit, causes the separation roller to rotate at idle in the first rotation direction, independently of the driving torque. The controller controls the motor. During feeding operations, including an operation of feeding a first medium and a second medium in this order, the controller provides a break period in which the motor is not driven. The break period contains a timing at which a rear edge of the first medium leaves a nip position between the feed roller and the separation roller.

If the rear edge of the first medium leaves the nip position between the feed roller and the separation roller of the active type, both opposite force generated by the kickback phenomenon and opposite force generated by the reverse rotation of the separation roller are applied at one time to the front edge of the second medium on the separation roller. As a result, a front portion of the second medium may be curled up.

In the configuration of the first aspect, however, the controller that controls the motor that applies driving torque to the separation roller provides the break period in which the motor is not driven during feeding operations, including an operation of feeding the first medium and the second medium in this order. This break period contains a timing at which a rear edge of the first medium leaves the nip position between the feed roller and the second separation roller. With this configuration, when the rear edge of the first medium leaves the nip position, the opposite force generated by the kickback phenomenon is applied to the front edge of the second medium on the separation roller, but the opposite force generated by the reverse rotation of the separation roller is not applied thereto. As a result, the front portion of the second medium on the separation roller is less likely to be curled up.

According to a second aspect, in addition to the configuration of the first aspect, the medium feeding apparatus may further include a first detector that detects passage of the media. The first detector may be disposed downstream of the nip position in the feeding direction. A transport roller that feeds the media to the downstream side may be disposed downstream of the first detector in the feeding direction. A second detector that detects the passage of the media may be disposed downstream of the transport roller in the feeding direction. The controller may set the break period to a period containing a time interval between when the second detector detects passage of a front edge of the first medium and when the first detector detects passage of the rear edge of the first medium.

In the configuration of the second aspect, the controller may set the break period to a period containing a time interval between when the second detector detects passage of a front edge of the first medium and when the first detector detects the passage of the rear edge of the first medium. This configuration makes it possible to reliably contain the timing at which the rear edge of the first medium leaves the nip position within the break period.

According to a third aspect, in addition to the configuration of the first or second aspect, the feed roller may make contact with a lowermost medium of the media mounted in a medium mount where one or media to be fed are mounted and rotate to feed the lowermost medium. The medium feeding apparatus may further include a plurality of suppression units that suppress front edges of the media from making contact with the separation roller by making contact with the front edges of the media other than at least the lowermost medium. The suppression units may be disposed upstream of the nip position and spaced along a width of the media in a direction intersecting the feeding direction.

When the front edges of the media mounted in the medium mount make contact with the outer circumferential surface of the separation roller, the separation roller presses the feed roller in conjunction with deformation of the outer circumferential surface of the separation roller. As a result, the separation roller may make contact with the feed roller at excessively strong force, thereby causing multi-feeding of the media.

In the configuration of the third aspect, however, the medium feeding apparatus may further include a plurality of suppression units that suppress front edges of the media from making contact with the separation roller by making contact with the front edges of the media other than at least the lowermost medium. The suppression units may be disposed upstream of the nip position and spaced along a width of the media in a direction intersecting the feeding direction. This configuration can reduce the risk of advantages, as described above, caused by the contact between the front edges of the media mounted in the medium mount and the outer circumferential surface of the separation roller.

According to a fourth aspect, in addition to the configuration of the third aspect, the suppression units may be arranged on both sides of the separation roller along the width of the media in the direction intersecting the feeding direction.

In the configuration of the fourth aspect, the suppression units may be arranged on both sides of the separation roller along the width of the media in the direction intersecting the feeding direction. This configuration can reduce the risk of the media angled by the suppression unit.

According to a fifth aspect, in addition to the configuration of the fourth aspect, the suppression units may be displaceable along a thickness of the media. The medium feeding apparatus may further include: an operation unit to be operated by a user; and an operation converter that converts movement of the operation unit into displacement of the suppression units.

In the configuration of the fifth aspect, the suppression units may be displaceable along a thickness of the media. The medium feeding apparatus may further include: an operation unit to be operated by a user; and an operation converter that converts movement of the operation unit into displacement of the suppression unit. This configuration can displace the suppression units in accordance with the total thickness of the media, thereby successfully feeding the media in accordance with their total thickness.

According to a sixth aspect, in addition to the configuration of the fifth aspect, the operation unit may be configured to be switched between a first position, a second position, and a third position. The medium feeding apparatus may further include a switching unit that switches between a first state in which driving power of the motor is transmitted to the separation roller and a second state in which the driving power of the motor is not transmitted to the separation roller. When the operation unit is in the first position, ends of the suppression units may not overlap the feed roller as seen from a side of a feeding route of the media and the switching unit may be in the first state. When the operation unit is in the second position, the ends of the suppression units may overlap the feed roller as seen from the side of the feeding route of the media and the switching unit may be in the first state. When the operation unit is in the third position, the ends of the suppression units may not overlap the feed roller as seen from the side of the feeding route of the media and the switching unit may be in the second state.

The configuration of the sixth aspect can provide various separation conditions to feed the media suitably in accordance with a type of the media.

According to a seventh aspect, in addition to the configuration of the fifth or sixth aspect, the operation unit may be operably disposed on an exterior of a housing.

In the configuration of the seventh aspect, the operation unit may be operably disposed on an exterior of a housing. This configuration enables the operation unit to be operated easily.

According to an eighth aspect, in addition to the configuration of one of the third to seventh aspects, the medium feeding apparatus may further include a nip member that nips the media mounted in the medium mount together with the feed roller. The nip member may be movable toward or away from the feed roller. A presser may press the nip member against the feed roller. The presser may include: a first spring that presses the nip member against the feed roller; and a second spring that presses the nip member against the feed roller. When a total thickness of the media mounted in the medium mount is smaller than a preset thickness, the first spring may exert spring force on the nip member, but the second spring may not exert spring force on the nip member. When the total thickness of the media mounted in the medium mount is equal to or larger than the preset thickness, the first spring may exert the spring force on the nip member, and the second spring may also exert the spring force on the nip member.

When a few media are fed, the nip member may press the media at excessive strong force, depending on a configuration of the medium feeding apparatus and a relationship between force at which the nip member presses the media and the number of media, in which case multi-feeding of the media might occur. When many media are fed, the nip member presses the media at insufficiently strong force, depending on these configuration and relationship, in which case failure to feed the media might occur. In the configuration of the eighth aspect, however, when a total thickness of the media mounted in the medium mount is smaller than a preset thickness, the first spring may exert spring force on the nip member, but the second spring may not exert spring force on the nip member. When the total thickness of the media mounted in the medium mount is equal to or larger than the preset thickness, the first spring may exert the spring force on the nip member, and the second spring may also exert the spring force on the nip member. This configuration can suppress the multi-feeding of the media when a few media are mounted in the medium mount and can also suppress the failure to feed the media when many media are mounted therein.

According to a ninth aspect, in addition to the configuration of one of the third to seventh aspects, the medium feeding apparatus may further include a nip member that nips the media mounted in the medium mount together with the feed roller. This nip member may be movable toward or away from the feed roller. A presser may press the nip member against the feed roller. The presser may have a torsion spring that presses the nip member against the feed roller. The torsion spring may include: a first arm that applies spring force of the torsion spring to the nip member; and a second arm that abuts against a spring abutment unit fixed in place. When the total thickness of the media mounted in the medium mount varies, an angle between the first arm and the second arm, an angle between a direction in which the first arm applies the spring force to the nip member and a distance in which the nip member moves to the feed roller, and a distance between a point at which the first arm applies the spring force to the nip member and a center of the torsion spring may vary.

If the presser is formed of a single compressed spring, for example, when many media are mounted in the medium mount, the presser is kept compressed, thereby applying a strong spring force. When a few media are mounted in the medium mount, the presser is stretched out, thereby applying a weak spring force. In short, the force at which the nip member presses media against the feed roller depends simply on the number of media. This may restrict flexibility of setting the force at which the nip member presses media against the feed roller.

In the configuration of the ninth aspect, however, when the total thickness of the media mounted in the medium mount varies, an angle between the first arm and the second arm, an angle between a direction in which the first arm applies the spring force to the nip member and a distance in which the nip member moves to the feed roller, and a distance between a point at which the first arm applies the spring force to the nip member and a center of the torsion spring may vary. As a result, the force at which the nip member presses media against the feed roller is independent of the number of media. This configuration makes it possible to flexibly set the force at which the nip member presses media against the feed roller, thereby successfully optimizing a condition in which the media are fed.

According to a tenth aspect, a configuration includes a feed roller that makes contact with a plurality of media and rotates to feed the media. A separation roller nips the media together with the feed roller to separate the media. A torque limiter applies preset rotational resistance to the separation roller. The feed roller makes contact with a lowermost medium of the media mounted in a medium mount where one or media to be fed are mounted and rotates to feed the lowermost medium. This configuration further includes a plurality of suppression units that suppress front edges of the media from making contact with the separation roller by making contact with the front edges of the media other than at least the lowermost medium. The suppression units are disposed upstream of the nip position and spaced along a width of the media in a direction intersecting the feeding direction.

When the front edges of media mounted in the medium mount are in contact with the outer circumferential surface of the separation roller, the separation roller presses the feed roller in conjunction with deformation of the outer circumferential surface of the separation roller. As a result, the separation roller may press the feed roller at excessively strong force, thereby causing multi-feeding of the media.

In the configuration of the tenth aspect, however, the suppression units are provided to suppress front edges of the media from making contact with the separation roller by making contact with the front edges of the media other than at least the lowermost medium. The suppression units are disposed upstream of the nip position and spaced along a width of the media in a direction intersecting the feeding direction. This configuration can suppress disadvantages, as described above, caused by the abutment of the front edges of media mounted in the medium mount against the outer circumferential surface of the separation roller.

According to an eleventh aspect, in addition to the configuration of the tenth aspect, the suppression units may be arranged on both sides of the separation roller along the width of the media in the direction intersecting the feeding direction.

The above configuration, in which the suppression units may be arranged on both sides of the separation roller along the width of the media in the direction intersecting the feeding direction, can reduce the risk of the media angled by the suppression units.

According to a twelfth aspect, in addition to the configuration of the tenth or eleventh aspect, the suppression units may be displaceable so as to adjust a size of space in which the media is fed to the nip position between the separation roller and the feed roller, thereby suppressing the number of media entering into the nip position. The configuration may further include: an operation unit to be operated by a user; and an operation converter that converts movement of the operation unit into displacement of the suppression unit.

In the configuration of the twelfth aspect, the suppression units are displaceable so as to adjust a size of space in which the media is fed to the nip position between the separation roller and the feed roller, thereby suppressing the number of media entering into the nip position. The configuration may further include: an operation unit to be operated by a user; and an operation converter that converts movement of the operation unit into displacement of the suppression unit. This configuration can displace the suppression units in accordance with the total thickness of the media, thereby successfully feeding the media in accordance with their total thickness.

According to a thirteenth aspect, an image reading apparatus includes: a reader that reads a medium; and the medium feeding apparatus according to one of the first to twelfth aspects which feeds the medium to the reader.

With the configuration of the thirteenth aspect, the image reading apparatus produces substantially the same effects as the medium feeding apparatus according to any of the first to twelfth aspects.

A description will be given of a medium feeding apparatus, an image reading apparatus, and a medium feeding method according to some embodiments of the present disclosure with reference to the accompanying drawings. In the following embodiments, a document scanner 1A is an example of the image reading apparatus. The document scanner 1A is designed to read an image on at least one surface of a medium, or an original sheet P. Hereinafter, the document scanner 1A is abbreviated as the scanner 1A, and the original sheet P is abbreviated as the sheet P.

The accompanying drawings have an X-Y-Z coordinate system. In this system, the X-axis is parallel to the widths of both the scanner 1A and the sheet P and intersects the feeding direction of the sheet P. The Y-axis is parallel to this feeding direction. The Z-axis, which is perpendicular to the Y-axis, is substantially orthogonal to both the surfaces of the sheet P to be transported. The scanner 1A has six surfaces: front, rear, left, right, upper, and lower surfaces. The front surface faces toward the positive (+) side of the Y-axis; the rear surface faces toward the negative (−) side of the Y-axis; the left surface faces toward the positive (+) side of the X-axis; the right surface faces toward the positive (−) side of the X-axis; the upper surface, which includes some upper parts, faces toward the positive (+) side of the Z-axis; and the lower surface, which includes some lower parts, faces toward the positive (−) side of the Z-axis. Hereinafter, the side to which the sheet P is to be transported, or the positive side of +Y-axis, is referred to as the downstream side, and the side opposite to this downstream side is referred to as the upstream side.

With reference to FIG. 1 and some other drawings, the scanner 1A will be described below. FIG. 1 illustrates the appearance of the scanner 1A in perspective. The scanner 1A includes a main unit 2 in which a reader 20 (see FIG. 2) reads an image on at least one surface of the sheet P. The main unit 2 has a lower unit 3 and an upper unit 4. The upper unit 4 is pivotable around a pin provided on the front surface of the lower unit 3. When the upper unit 4 is pivoted toward the front side of the scanner 1A, the interior of the scanner 1A is exposed, so that a user can easily remove the sheet P from the transport route if a sheet P is stacked inside.

The main unit 2 has a sheet mount 11 on its rear surface. The sheet mount 11 is detachably attached to the main unit 2 and has a mounting surface 11*a* on which a sheet P is to be transported is mounted. The sheet mount 11 is provided with a pair of edge guides: a first edge guide 12A and a second edge guide 12B. Both the first edge guide 12A and the second edge guide 12B guide the side edges of a sheet P. Further, a guide surface U1 of the first edge guide 12A and a guide surface U2 of the second edge guide 12B make contact with and guide the side edges of the sheet P.

The sheet mount 11 has a first paper support 8 and a second paper support 9 that are retractable in the sheet mount 11. By pulling out both the first paper support 8 and the second paper support 9 from the sheet mount 11 as illustrated in FIG. 1, the user can adjust the length of the mounting surface 11*a*.

The main unit 2 has an operation panel 7 on the upper surface of upper unit 4. The operation panel 7 is a user interface (UI) and allows the user to perform various settings of a read operation and indicates the set contents. In this embodiment, the operation panel 7 may be a touch panel that can display information and accept input operations. In short, the operation panel 7 serves as both an operation unit that accepts input operations and a display unit that indicates various information. The upper unit 4 has a supply port 6 on its upper surface which leads to the interior of the main unit 2. Via the supply port 6, the sheet P on the sheet mount 11 is transported to a reader 20 in the main unit 2. The lower unit 3 has an ejection tray 5 on its front surface to which the sheet P is to be ejected.

The upper unit 4 has a housing 21 with an operation unit 75*a* to be operated by the user. The operation unit 75*a* can have three positions: a first opposition that is a neutral position; a second position in which the operation unit 75*a* is depressed forward; and a third position which the operation unit 75*a* is depressed rearward. Details of these positions will be described later. By operating the operation unit 75*a*, the user can switch sheet feeding conditions. Details of this operation will be described later.

Figure 2:
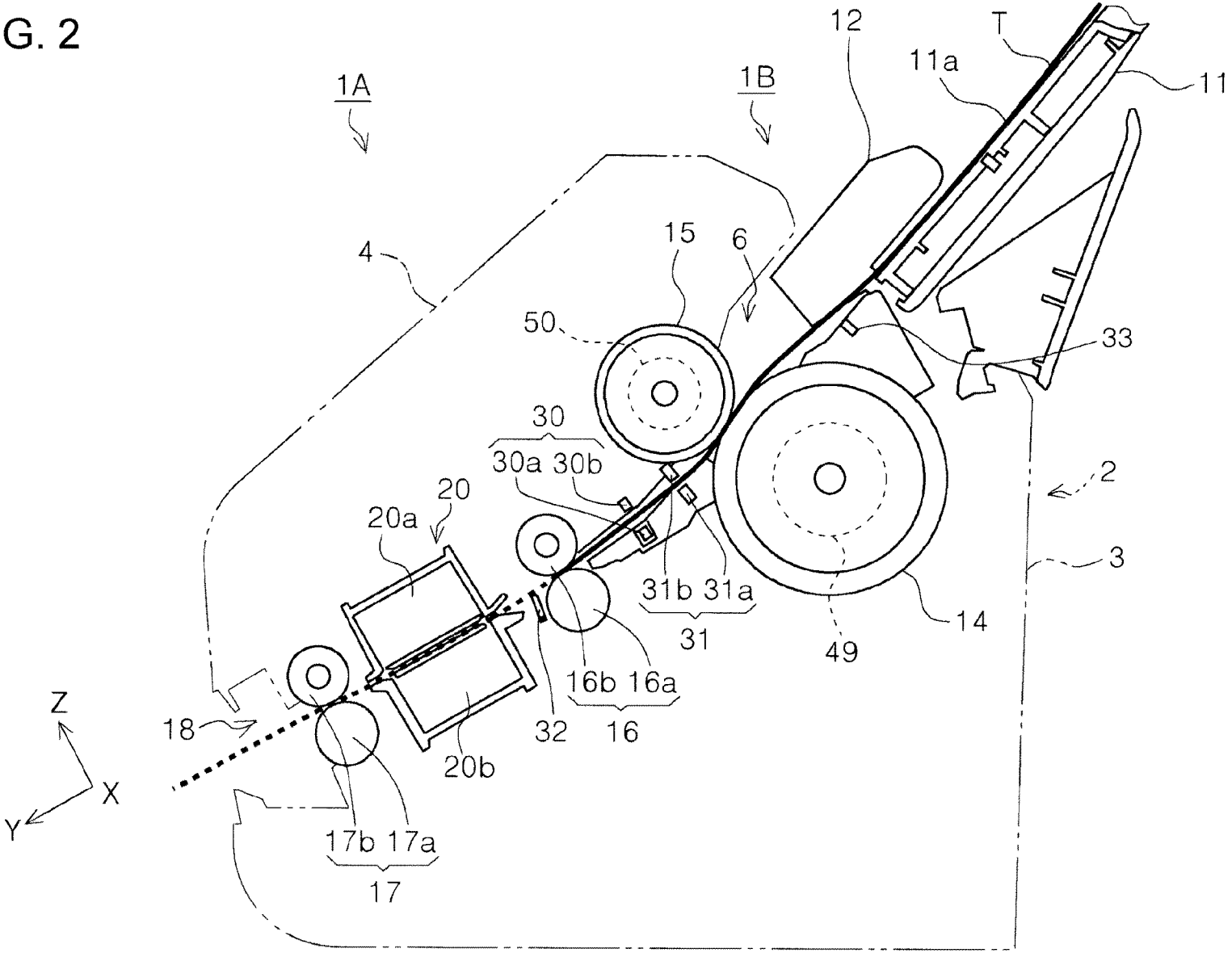
FIG. 2 is a side cross-sectional view of the sheet feeding route inside the scanner.

With reference to FIG. 2 and some other drawings as appropriate, a description will be given of a sheet feeding apparatus 1B, more specifically, the sheet feeding route inside the scanner 1A. FIG. 2 is a side cross-sectional view of the sheet feeding route inside the scanner 1A. The scanner 1A includes the sheet feeding apparatus 1B. The sheet feeding apparatus 1B has some components for use in transporting the sheet P inside the scanner 1A; these components include the sheet mount 11, the edge guides 12 (12A and 12B), feed rollers 14, and separation rollers 15. In one aspect, the sheet feeding apparatus 1B may perform all functions of the scanner 1A, aside from the reading function that will be described later. In other words, the sheet feeding apparatus 1B may include all components of the scanner 1A aside from the reader 20. In another aspect, the sheet feeding apparatus 1B can be regards as the entire scanner 1A regardless of the presence of the reader 20, because the sheet P is transported inside the scanner 1A. In FIG. 2, the solid line T indicates the sheet feeding route, or a route along which a sheet P is to be transported. The sheet feeding route T is formed inside the space defined by the lower unit 3 and the upper unit 4. In this embodiment, the sheet feeding route T is defined as a route formed between the sheet mount 11 and a transport roller pair 16. In FIG. 2, a sheet transport route formed downstream from the transport roller pair 16 is therefore indicated by a broken line.

Disposed at the upstream end of the sheet feeding route T is the sheet mount 11. Disposed downstream of the sheet mount 11 are the feed rollers 14 and the separation rollers 15. The feed rollers 14 feed sheets P from the mounting surface 11*a* of the sheet mount 11 to the reader 20. The separation rollers 15 separate one of the sheets P from the others by nipping the sheet P together with the feed rollers 14.

The feed rollers 14 make contact with the lowermost one of the sheets P that have been mounted on the mounting surface 11*a* of the sheet mount 11. When a plurality of sheets P are mounted on the mounting surface 11*a* of the sheet mount 11 in the scanner 1A, the feed rollers 14 feed the sheets P one by one to the downstream side in the order from the lowermost sheet P. Disposed upstream of the feed rollers 14 is a mounted sheet detector 33 that detects the presence of a sheet P mounted on the sheet mount 11.

The separation rollers 15 are disposed opposite the feed rollers 14 in order to suppress a plurality of sheets P from being fed at one time between the feed rollers 14 and the separation rollers 15, namely, in order to suppress multi-feeding of the sheets P therebetween. Details of the feed rollers 14 and the separation rollers 15 will be described later.

Arranged downstream of the feed rollers 14 is the transport roller pair 16, the reader 20 that reads an image from a sheet P, and an ejection roller pair 17. The transport roller pair 16 includes a driving transport roller 16*a* and a driven transport roller 16*b*; the driving transport roller 16*a* rotates by means of the driving power from a transport roller motor 46 (see FIG. 3), and the driven transport roller 16*b* is rotated in conjunction with the rotation of the driving transport roller 16*a*. After having been fed from between the feed rollers 14 and the separation rollers 15, the sheet P is nipped between the driving transport roller 16*a* and the driven transport roller 16*b* of the transport roller pair 16 disposed downstream of both the feed rollers 14 and the separation rollers 15 and then transported to the reader 20 disposed downstream of the transport roller pair 16.

Disposed downstream of the nip position between the feed rollers 14 and the separation rollers 15 is a first sheet detector 31. The first sheet detector 31, which may be an optical sensor, for example, includes a light emitter 31*a* and a light receiver 31*b* disposed opposite each other with the sheet feeding route T therebetween. When the light emitter 31*a* outputs detection light, this detection light is received by the light receiver 31*b*. Then, the light receiver 31*b* outputs an electric signal proportional to the intensity of the received detection light to a controller 40 (see FIG. 3). If a sheet P passes across the detection light from the light emitter 31*a*, the level of the electric signal varies. In this way, the controller 40 can sense the passage of the front or rear edge of the sheet P between the light emitter 31*a* and the light receiver 31*b*.

Disposed downstream of the first sheet detector 31 is multi-feeding detector 30 that detects the multi-feeding of sheets P. The multi-feeding detector 30 includes an ultrasound emitter 30*a* and an ultrasound receiver 30*b* disposed opposite each other with the sheet feeding route T therebetween. When the ultrasound emitter 30*a* outputs an ultrasonic wave, this ultrasonic wave is received by the ultrasound receiver 30*b*. Then, the ultrasound receiver 30*b* outputs an electric signal proportional to the intensity of the received ultrasonic wave to the controller 40. If the multi-feeding of sheets P occurs, the level of the electric signal varies. In this way, the controller 40 can sense the multi-feeding of the sheets P.

Disposed downstream of the multi-feeding detector 30, more specifically, the transport roller pair 16 is a second sheet detector 32, which may be a contact sensor with a lever. In response to the passage of the front or rear edge of the sheet P, the lever of the second sheet detector 32 is pivoted, and then the second sheet detector 32 varies an electric signal and sends it to the controller 40. In this way, the controller 40 senses that the front or rear edge of the sheet P has passed near the second sheet detector 32. With the above first sheet detector 31 and second sheet detector 32, the controller 40 can recognize at which position the sheet P is being transported along the sheet feeding route T.

The reader 20, which is disposed downstream of the second sheet detector 32, includes an upper read sensor 20*a* and a lower read sensor 20*b*. The upper read sensor 20*a* is disposed inside the upper unit 4, whereas the lower read sensor 20*b* is disposed inside the lower unit 3. In this embodiment, each of the upper read sensor 20*a* and the lower read sensor 20*b* may be a contact image sensor module (CISM), for example.

After an image on at least one surface of the sheet P has been read by the reader 20, the sheet P is nipped by the ejection roller pair 17 disposed downstream of the reader 20. Then, the sheet P is ejected to the outside of the sheet feeding apparatus 1B through the ejection port 18 disposed on the front surface of the lower unit 3. The ejection roller pair 17 includes a driving ejection roller 17*a* and a driven ejection roller 17*b*. The driving ejection roller 17*a* rotates by means of the driving power from the transport roller motor 46 (see FIG. 3), and the driven ejection roller 17*b* is rotated in conjunction with the rotation of the driving ejection roller 17*a*.

Figure 3:
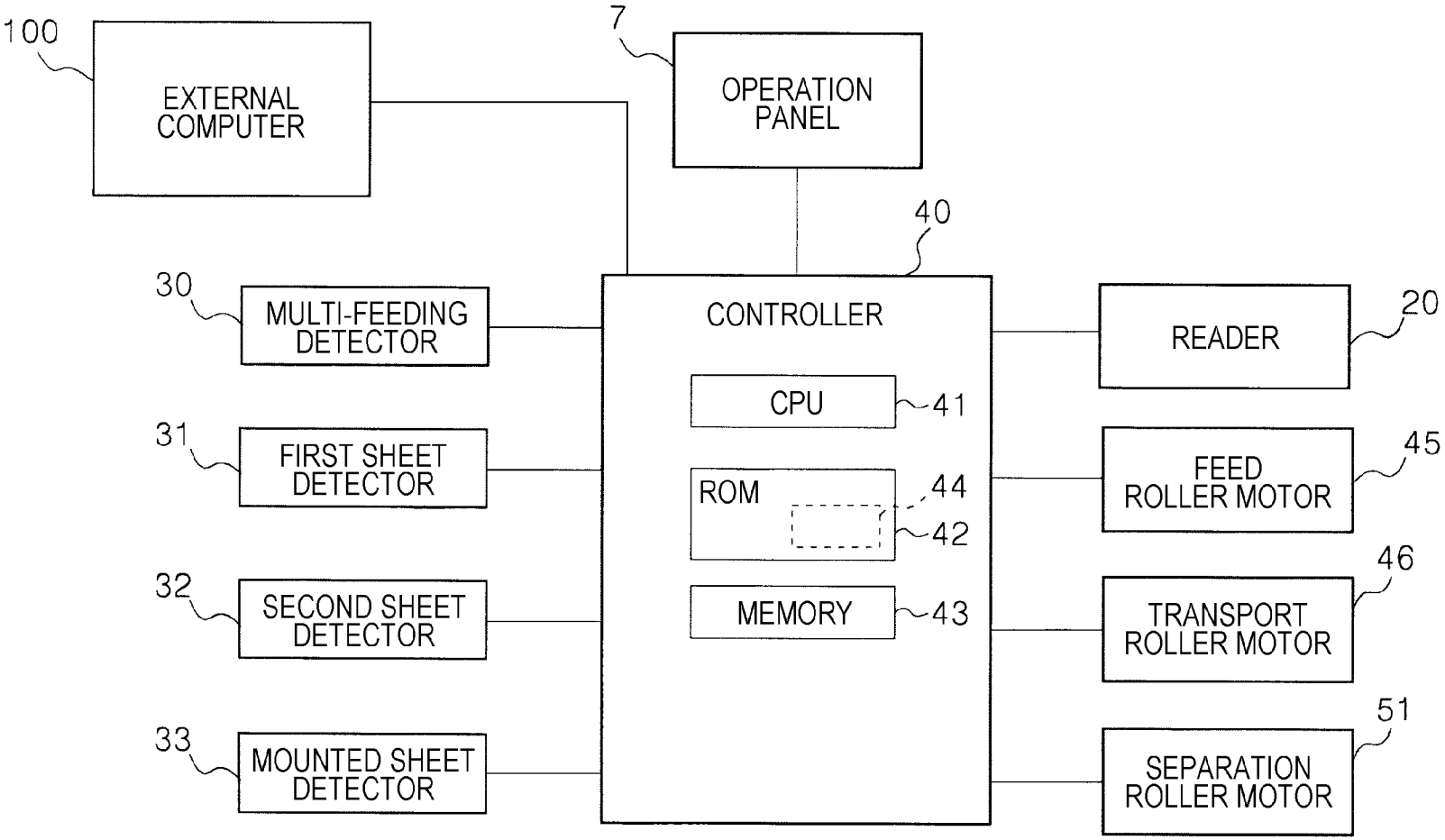
FIG. 3 is a block diagram of the control system in the scanner.

With reference to FIG. 3, a description will be given below of a control system in the scanner 1A and the sheet feeding apparatus 1B. FIG. 3 is a block diagram of the control system of the scanner 1A. As illustrated in FIG. 3, the controller 40 controls various operations, including operations of feeding, transporting, ejecting, and reading sheets P, of the scanner 1A and the sheet feeding apparatus 1B. The controller 40 receives a signal from the operation panel 7 or transmits a signal for use in controlling the display of the operation panel 7 to the operation panel 7.

The controller 40 controls the driving sources for the feed rollers 14, the separation rollers 15, the transport roller pair 16, and the ejection roller pair 17 as illustrated in FIG. 2. More specifically, the controller 40 controls a feed roller motor 45, a separation roller motor 51, and the transport roller motor 46. The controller 40 receives read data from the reader 20 or transmits a signal for use in controlling the reader 20 to the reader 20. Furthermore, the controller 40 receives signals from detectors, including the multi-feeding detector 30, the first sheet detector 31, the second sheet detector 32, and the mounted sheet detector 33.

The controller 40 includes a CPU 41, a ROM 42, and a memory 43. The CPU 41 controls an entire operation of the scanner 1A by performing various calculations in accordance with a program 44 stored in the ROM 42. The memory 43, which is an example of a storage unit, may be a nonvolatile memory from which data can be read or to which data can be written. The memory 43 stores all parameters and data required for the control, which may be updated as appropriate by the controller 40. The scanner 1A is connectable to an external computer 100 so that the controller 40 can receive various information from the external computer 100.

Figure 5:
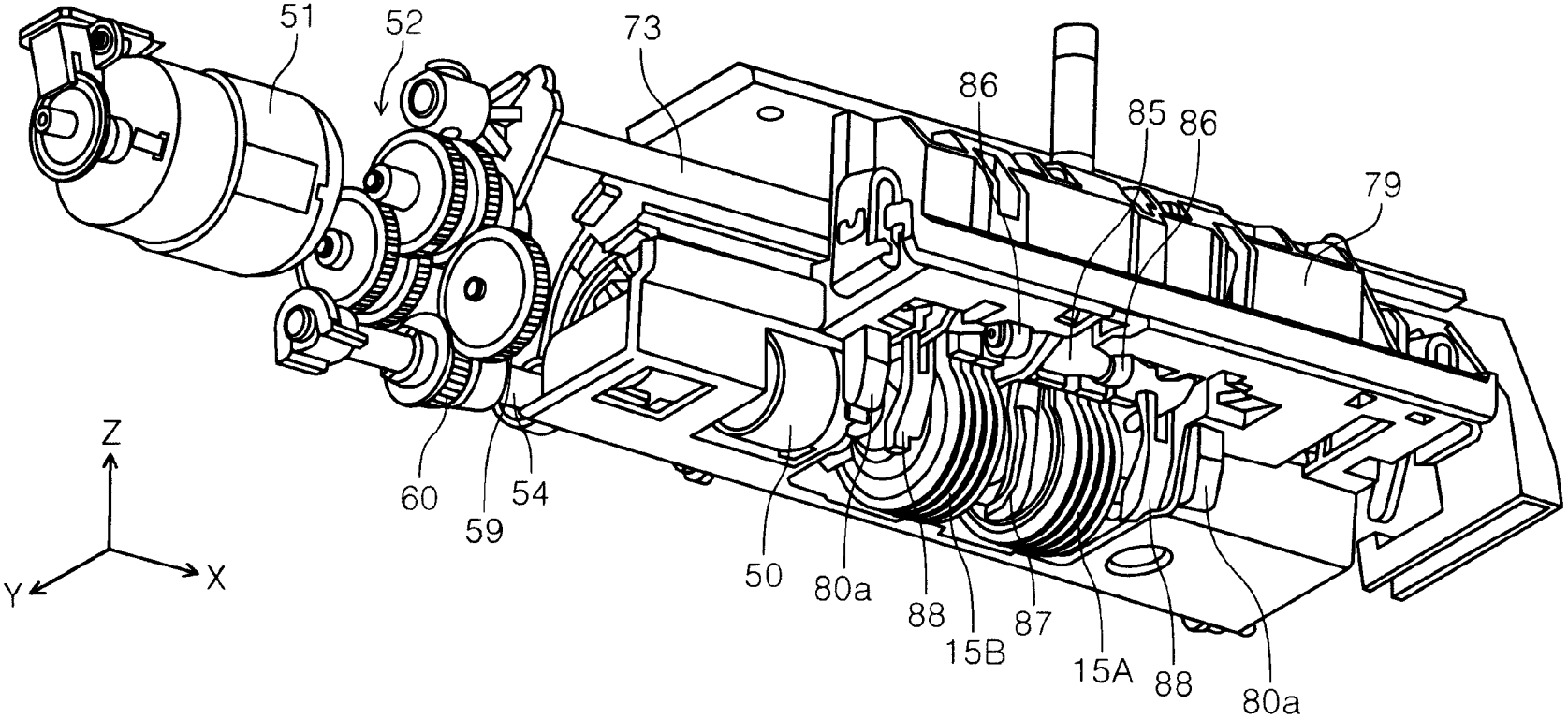
FIG. 5 is another perspective view of the separation rollers and the surrounding parts.
Figure 6:
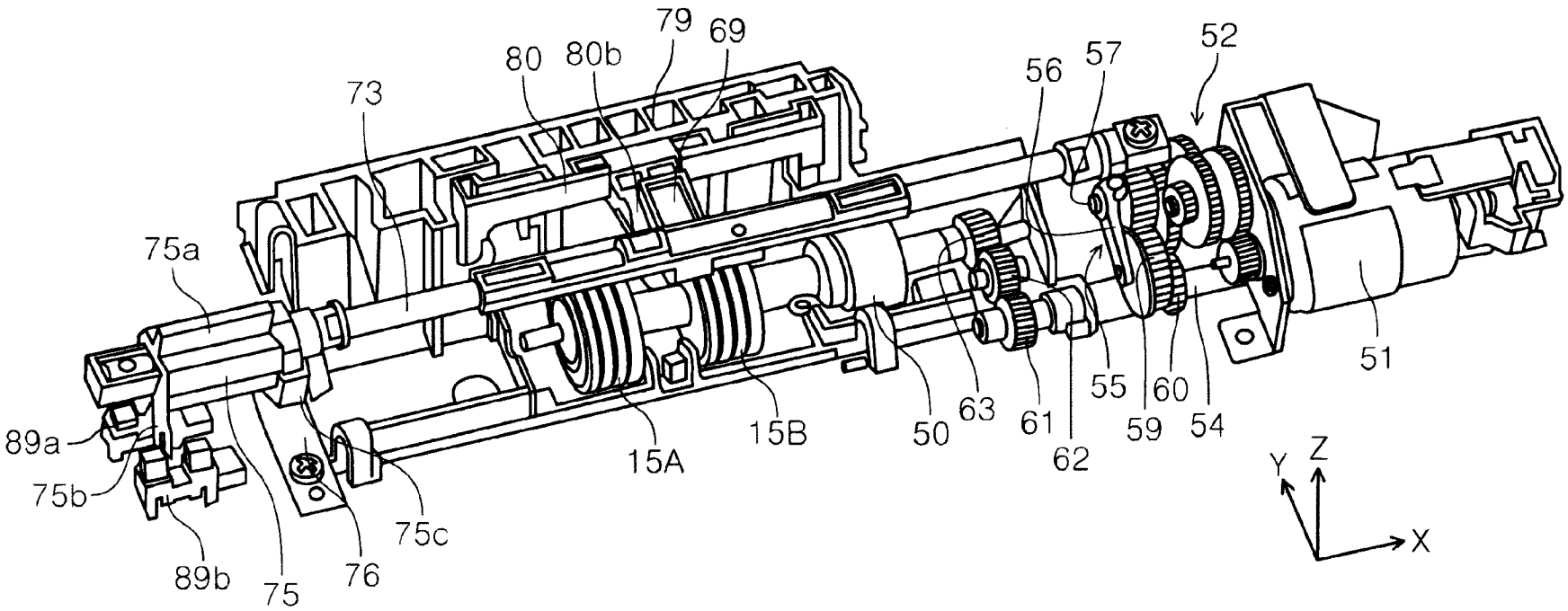
FIG. 6 is still another perspective view of the separation rollers and the surrounding parts.
Figure 7:
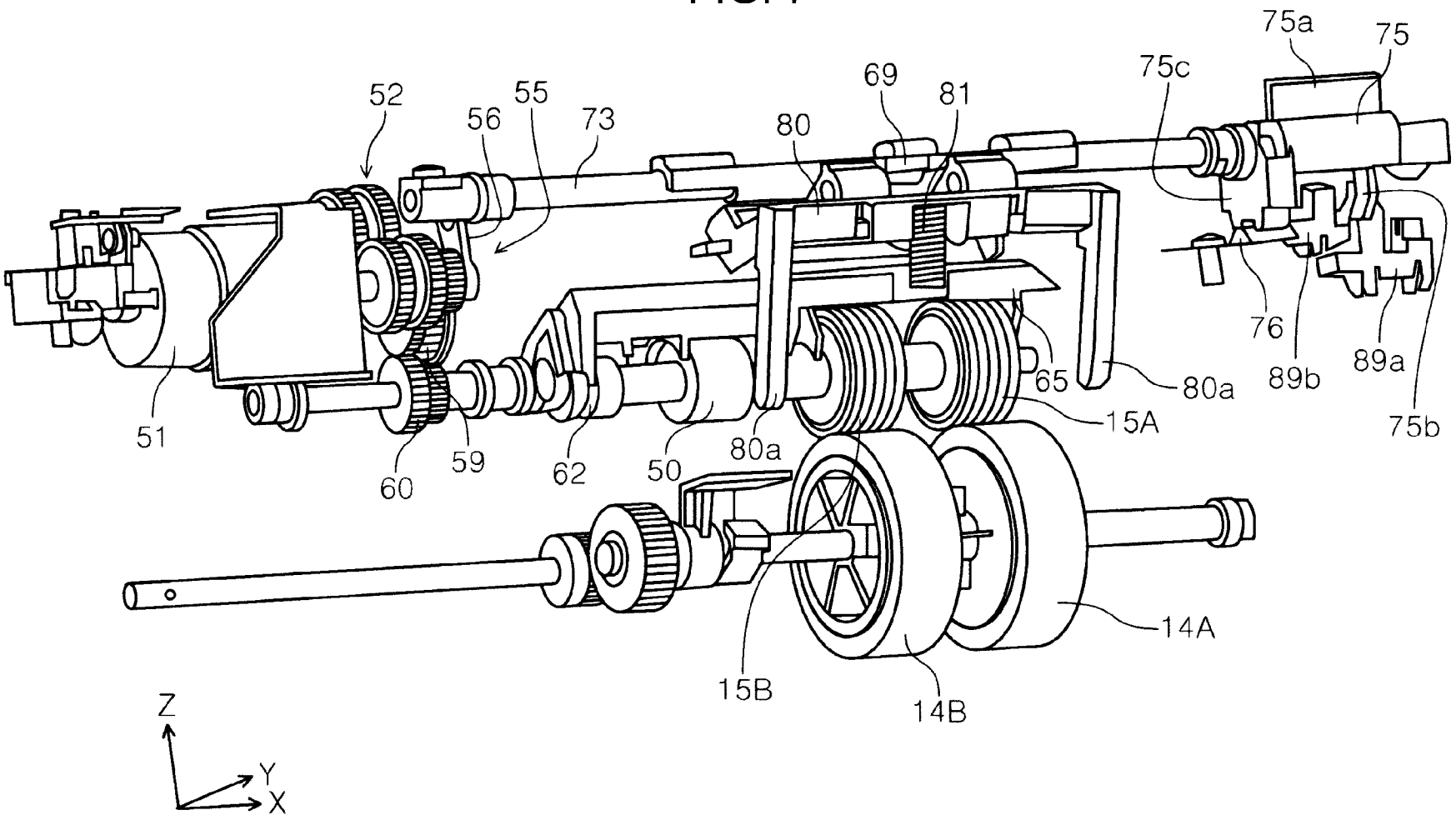
FIG. 7 is a perspective view of the feed rollers, the separation rollers, and the suppression units.
Figure 8:
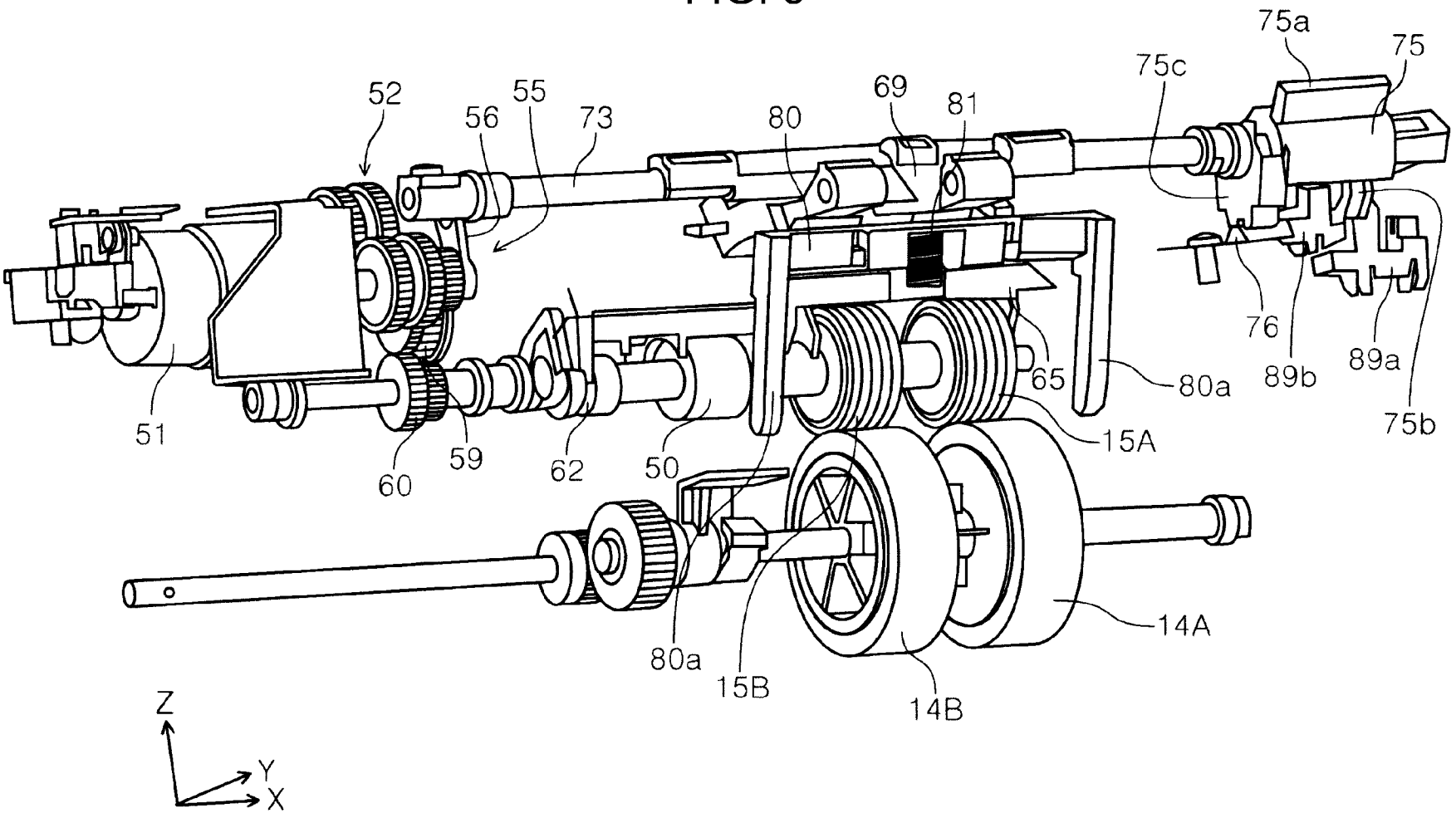
FIG. 8 is another perspective view of the feed rollers, the separation rollers, and the suppression units.

With reference to FIGS. 4 to 8, a description will be given in detail below of the feed rollers 14 and the separation rollers 15. In this embodiment, as illustrated in FIGS. 7 and 8, two feed rollers 14, or a first feed roller 14A and a second feed roller 14B, are spaced along the width of the sheet P. More specifically, the first feed roller 14A and the second feed roller 14B are disposed symmetrically with respect to the center of the width of the sheet P. Likewise, two separation rollers 15, or a first separation roller 15A and a second separation roller 15B, are spaced along the width of the sheet P. More specifically, the first separation roller 15A and the second separation roller 15B are disposed symmetrically with respect to the center of the width of the sheet P. Hereinafter, the first feed roller 14A and the second feed roller 14B are referred to as the feed rollers 14 unless they need to be distinguished from each other. Likewise, the first separation roller 15A and the second separation roller 15B are referred to as the feed rollers 14.

The feed roller motor 45 (see FIG. 3) transmits driving power to the feed rollers 14 via a one-way clutch 49 (see FIG. 2). When receiving rotation torque from the feed roller motor 45, the feed rollers 14 rotate counterclockwise in the page of FIG. 2, thereby feeding a sheet P to the downstream side. Hereinafter, the rotation direction in which the feed rollers 14 rotate to feed the sheet P to the downstream side is referred to as the forward rotation direction, and the opposite rotation direction is referred to as the reverse rotation direction. Likewise, the rotation direction in which the feed roller motor 45 rotates to feed the sheet P to the downstream side is referred to as the forward rotation direction, and the opposite rotation direction is referred to as the reverse rotation direction.

With the one-way clutch 49 disposed on the driving power transmission route between each feed roller 14 and the feed roller motor 45 (see FIG. 3), the feed rollers 14 do not rotate in the reverse rotation direction even when the feed roller motor 45 rotates in the reverse rotation direction. Even when the feed roller motor 45 stops rotating, the feed rollers 14 can be rotated in the forward rotation direction while being in contact with the sheet P being fed. When the second sheet detector 32 disposed downstream of the transport roller pair 16 detects the front edge of the sheet P, for example, the controller 40 may stop driving the feed roller motor 45 but continue to drive the transport roller motor 46. In this case, the transport roller pair 16 transports the sheet P, and the feed rollers 14 are rotated in the forward rotation direction while being in contact with the sheet P being fed.

The separation roller motor 51 (e.g., see FIG. 4) transmits rotation torque to the separation rollers 15 via the torque limiter 50. Details of the driving power transmission route between the separation roller motor 51 and the separation rollers 15 will be described later.

When no or a single sheet P is present between the feed rollers 14 and the separation rollers 15, if the rotation torque that causes the separation rollers 15 to rotate in the forward rotation direction exceeds an upper torque limit of the torque limiter 50, the torque limiter 50 slips on the separation rollers 15. In which case, the separation rollers 15 rotate at idle in the forward rotation direction, independently of the rotation torque from the separation roller motor 51. Hereinafter, the rotation direction in which the separation rollers 15 is rotated in conjunction with the rotation of the feed rollers 14 or the sheet P being fed is referred to as the forward rotation direction (first rotation direction), and the opposite rotation direction is referred to as the reverse rotation direction (second rotation direction). Likewise, the rotation direction in which the separation roller motor 51 rotates to rotate the separation rollers 15 in the forward rotation direction is referred to as the forward rotation direction, and the opposite rotation direction is referred to as the reverse rotation direction. While the sheet P is being fed, the separation roller motor 51 is normally rotating in the reverse rotation direction, thereby generating driving torque to cause the separation rollers 15 to rotate in the reverse rotation direction.

If a first sheet P to be fed and a second sheet P enter together into between the feed rollers 14 and the separation rollers 15, the second sheet P slips on the first sheet P, and then the separation roller motor 51 transmits driving torque to the separation rollers 15 in the reverse rotation direction. The second sheet P is thereby returned to the upstream side. In this way, the multi-feeding is suppressed.

The feed rollers 14 and the separation rollers 15, each of which has an outer circumferential surface made of an elastic material such as elastomer, satisfy the following relationships:

$\mu1>\mu2$, $\mu1>\mu3$, $\mu1>\mu4$, $\mu2<\mu3$, $\mu2<\mu4$, and $\mu4<\mu3$, where $\mu1$ denotes a coefficient of friction between the feed rollers 14 and the separation rollers 15, $\mu2$ denotes a coefficient of friction between sheets P, $\mu3$ denotes a coefficient of friction between the feed rollers 14 and a sheet P, and $\mu4$ denotes a coefficient of friction between the separation rollers 15 and a sheet P.

Figure 4:
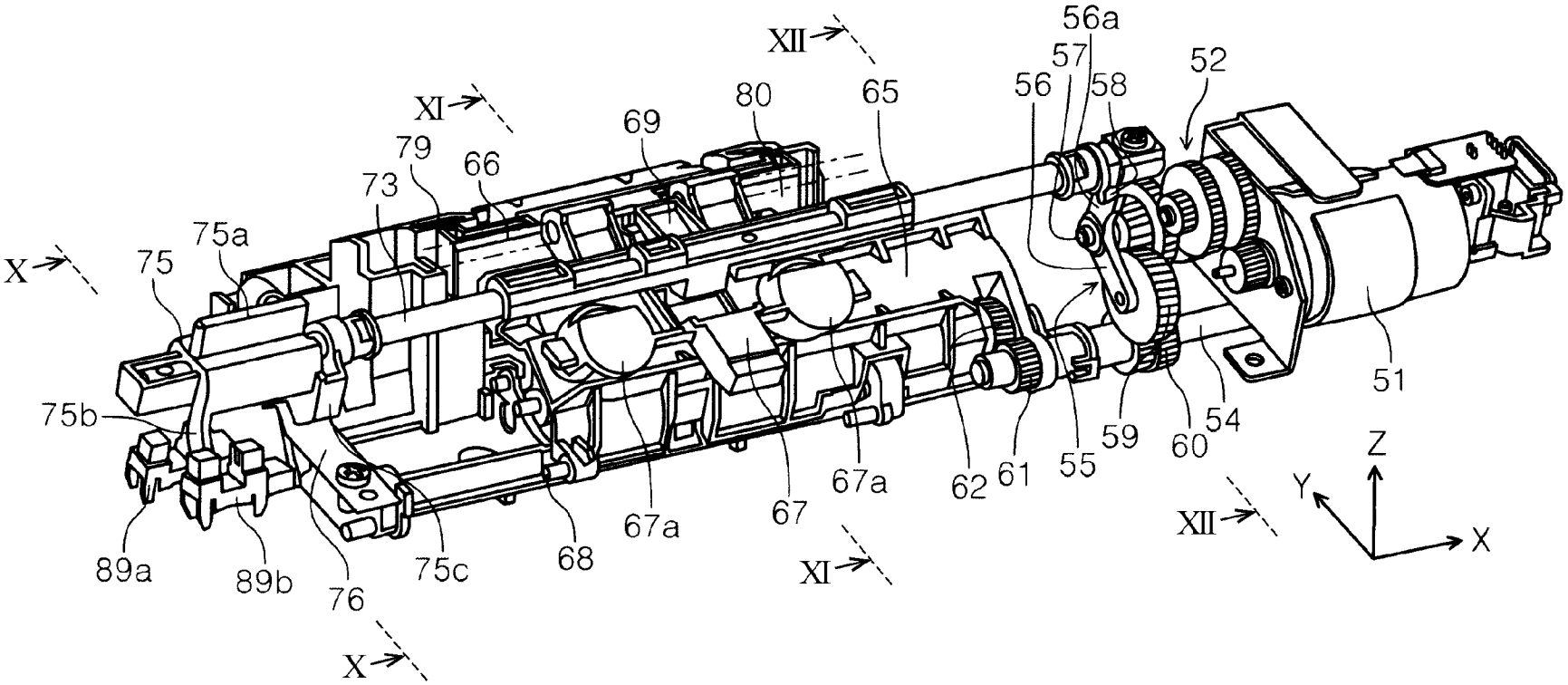
FIG. 4 is a perspective view of the separation rollers and surrounding parts.

Next, a description will be given of the driving power transmission route between the separation roller motor 51 and the separation rollers 15. As illustrated in FIG. 4, the separation roller motor 51 transmits the driving power to a switching unit 55 via a pinion group 52. The switching unit 55 has a power-transmitting pinion 59, which engages with or is separated from a power-transmitted pinion 60, thereby switching between an engagement state and a non-engagement state.

The power-transmitting pinion 59 is provided with an arm member 56, which is pivotable around a shaft 57. The arm member 56 extends from the shaft 57 in two directions: first and second directions. Further, an end of the arm member 56 which extends in the first direction is provided with the power-transmitting pinion 59, whereas the other end extending in the second direction forms a cam follower unit 56*a*, which engages with a cam 58 that pivots the cam follower unit 56*a*, namely, the arm member 56.

The cam 58 is provided in a first end of the shaft 73. A second end of the shaft 73 is provided with an operation member 75, which includes the operation unit 75*a* that has been described with reference to FIG. 1. When the operation unit 75*a* is operated, both the shaft 73 and the cam 58 rotate together to pivot the arm member 56. In response to the operation of the operation unit 75*a*, the power-transmitting pinion 59 engages with or is separated from the power-transmitted pinion 60, thereby switching between the engagement and non-engagement states. In other words, the power-transmitting pinion 59 switches between a first state and a second state; the first state is a state where the driving power transmission route between the separation roller motor 51 and the separation rollers 15 is formed, and the second state is a state where the driving power transmission route is interrupted.

The operation member 75 further includes a detected unit 75*b* and a latched unit 75*c*. Disposed on the rotation locus of the detected unit 75*b* drawn by the rotation of the operation member 75 are position sensors 89*a* and 89*b*, each of which may be an optical sensor. The controller 40 (FIG. 3) detects the position of the operation member 75, based on the combination of detection signals from the position sensors 89*a* and 89*b*.

Figure 10A:
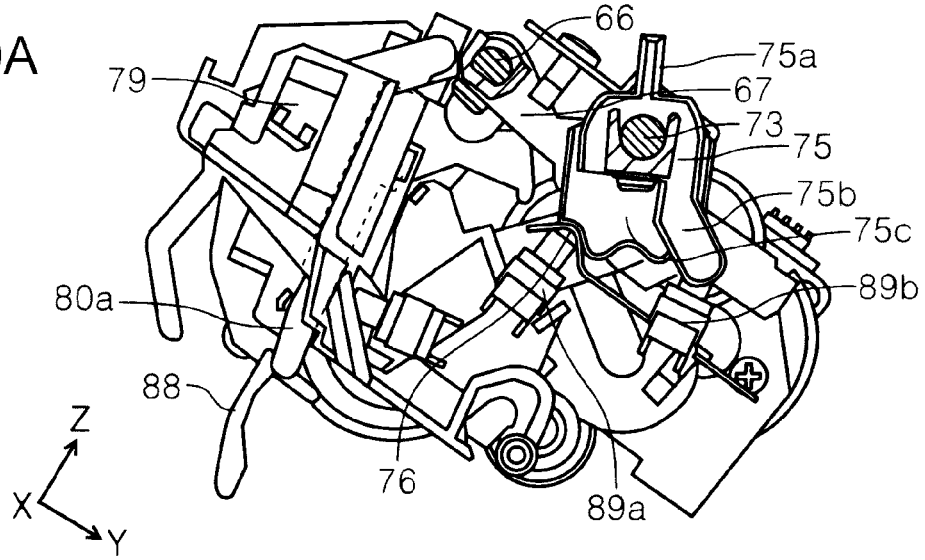
FIG. 10A is a cross-sectional view taken along the line X-X of FIG. 4 when the operation unit is in a second position.
Figure 10B:
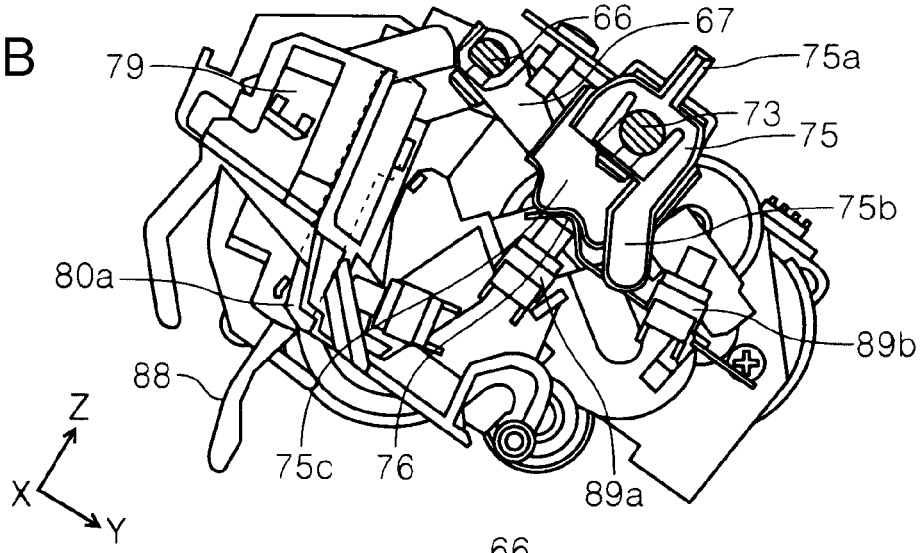
FIG. 10B is a cross-sectional view taken along the line X-X of FIG. 4 when the operation unit is in a first position.
Figure 10C:
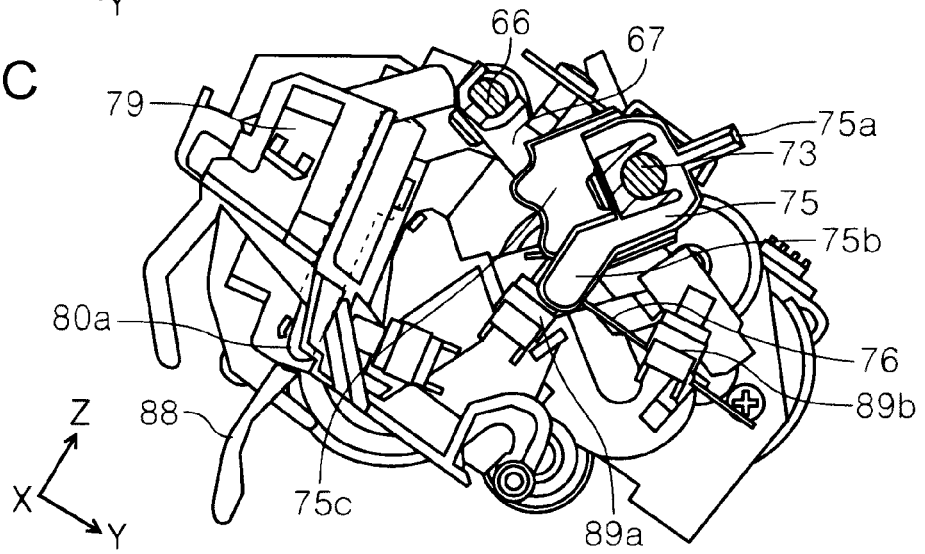
FIG. 10C is a cross-sectional view taken along the line X-X of FIG. 4 when the operation unit is in a third position.

The latched unit 75*c* is attached to a plate spring 76. As illustrated in FIGS. 10A to 10C, the latched unit 75*c* has a recess on its surface facing the plate spring 76. A portion of the plate spring 76 is accommodated in the recess, thereby maintaining the position of the operation member 75.

With reference to FIG. 4 again, the power-transmitted pinion 60 is attached to a shaft 54, which is provided with a pinion 61 that engages with a pinion 62. As illustrated in FIG. 6, the pinion 62 engages with a pinion 63, which transmits driving power from the separation roller motor 51 to the torque limiter 50.

Figure 12A:
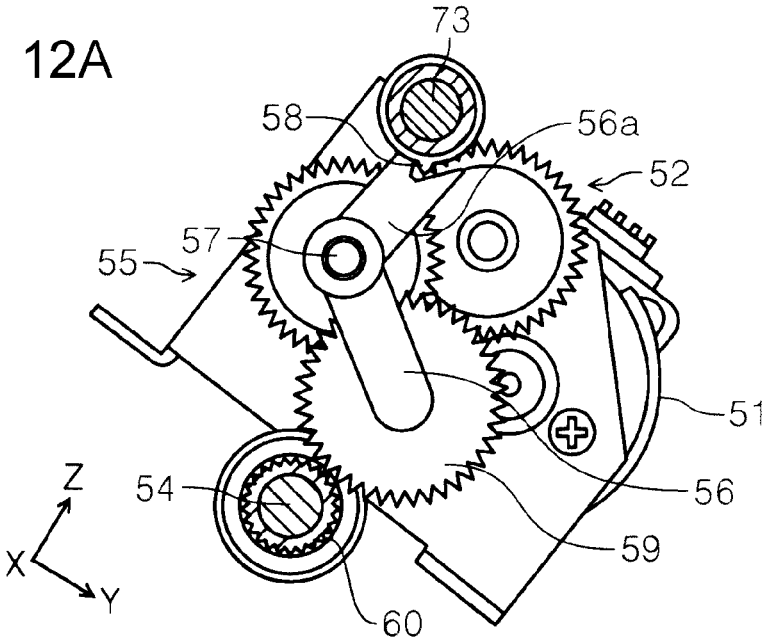
FIG. 12A is a cross-sectional view taken along the line XII-XII of FIG. 4 when the operation unit is in the first or second position.
Figure 12B:
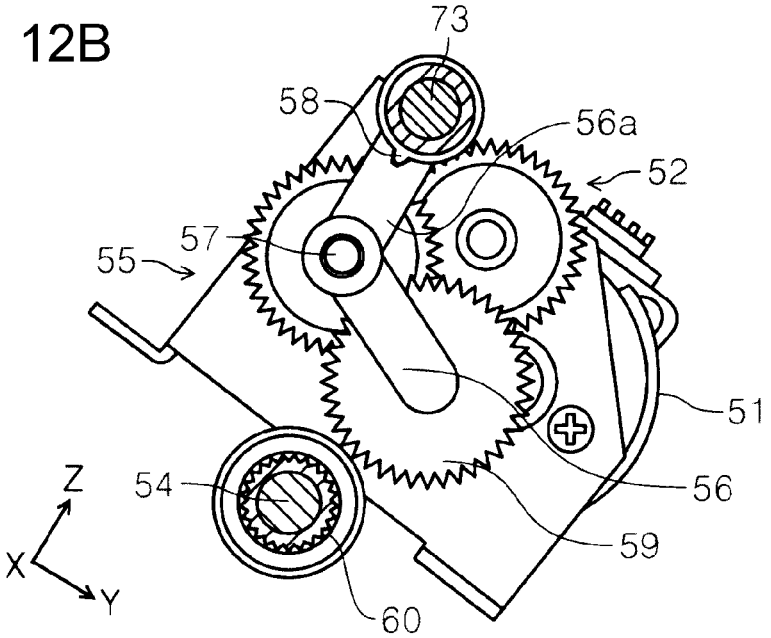
FIG. 12B is a cross-sectional view taken along the line XII-XII of FIG. 4 when the operation unit is in the third position.

With reference to FIGS. 10A to 10C and FIGS. 12A and 12B, a description will be given of the relationship between the operation of the operation unit 75*a* and the engagement state of the power-transmitting pinion 59 and the power-transmitted pinion 60. The operation unit 75*a* can be set to the first position as illustrated in FIG. 10B, the second position as illustrated in FIG. 10A, or the third position illustrated in FIG. 10C. FIG. 12A illustrates a first state of the switching unit 55 where the operation unit 75*a* is in the first position as illustrated in FIG. 10B. In this state, the cam 58 does not engage with the cam follower unit 56*a*, and the power-transmitting pinion 59 engages with the power-transmitted pinion 60. As a result, the switching unit 55 assumes the first state where the driving power of the separation roller motor 51 is transmitted to the separation rollers 15. FIG. 12B illustrates a second state of the switching unit 55 where the operation unit 75*a* is in the third position as illustrated in FIG. 10C. In this state, the cam 58 engages with the cam follower unit 56*a*, and the power-transmitting pinion 59 is separated from the power-transmitted pinion 60. As a result, the switching unit 55 assumes the second state where the driving power of the separation roller motor 51 is not transmitted to the separation rollers 15. When the operation unit 75*a* is switched from the first position to the second position as illustrated in FIG. 10A, the cam 58 that has been in the first state in FIG. 12A rotates counterclockwise in the page of FIGS. 12A and 12B. As a result, the cam 58 is kept separated from the cam follower unit 56*a*. In which case, the switching unit 55 maintains the first state where the driving power of the separation roller motor 51 is transmitted to the separation rollers 15.

When the switching unit 55 enters the second state where the driving power of the separation roller motor 51 is not transmitted to the separation rollers 15, the separation rollers 15 does not rotate in the reverse rotation direction and is rotatable freely. In other words, when the switching unit 55 enters the second state, the separation rollers 15 do not separate sheets P. Hereinafter, the feeding of sheets P in this state is referred to below as the "non-separation mode". The feeding of the sheets P in such a way the separation rollers 15 separate the sheets P is referred to below as the "separation mode".

Next, a description will be given of a manner in which the switching unit 55 switches pressing forces at which the separation rollers 15 presses the feed rollers 14. The separation rollers 15 are supported by a separation roller holder 65 as illustrated in FIG. 4. The separation roller holder 65 is pivotable around a shaft 68. When the separation roller holder 65 pivots, the separation rollers 15 move relative to the feed rollers 14. The shaft 68 and the shaft 54 share the same rotation center.

Disposed above the separation roller holder 65 is a spring holding member 67, which has two spring holders 67*a*. Between each spring holder 67*a* and the separation roller holder 65 is a spring 64 (see FIGS. 11A to 11C), which is an example of a presser. The spring 64 generates spring force to press the separation roller holder 65, or the separation rollers 15, against the feed rollers 14. The spring holding member 67 is pivotable around the shaft 66.

Disposed above the spring holding member 67 is a cam member 69, which is attached to the shaft 73 rotatable by the operation of the operation unit 75*a*. The cam member 69 has a cam 69*a* as illustrated in FIGS. 11A to 11C, which engages with the spring holding member 67.

Figure 11A:
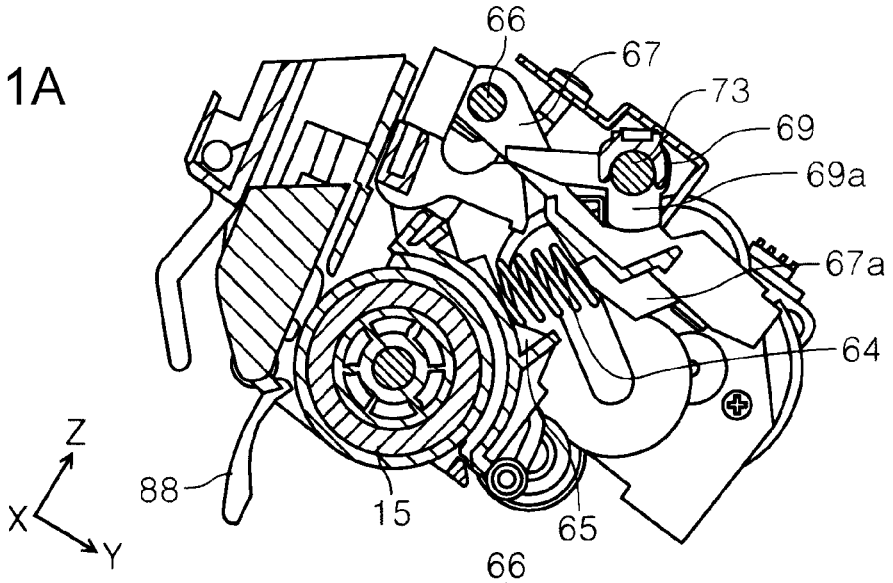
FIG. 11A is a cross-sectional view taken along the line XI-XI of FIG. 4 when the operation unit is in the second position.
Figure 11B:
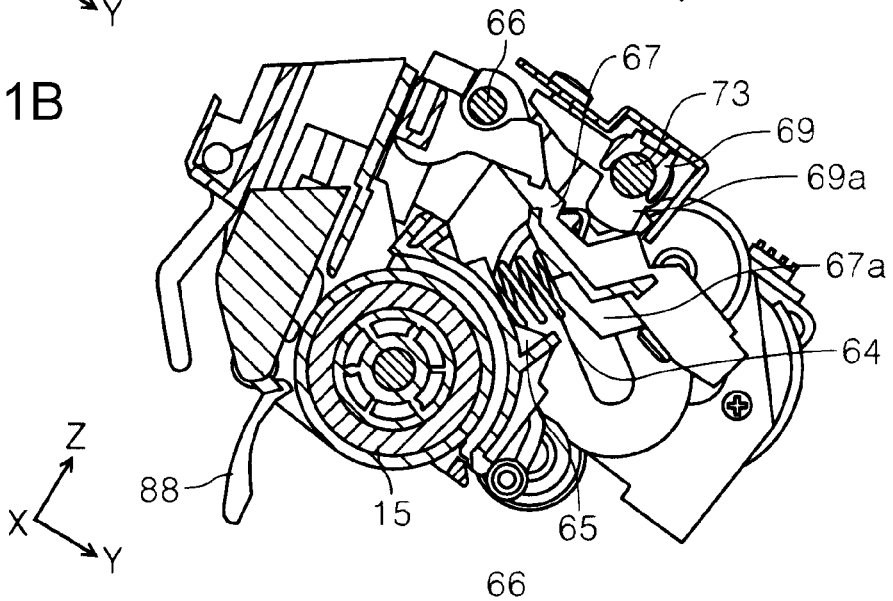
FIG. 11B is a cross-sectional view taken along the line XI-XI of FIG. 4 when the operation unit is in the first position.

FIG. 11B illustrates a state of the separation rollers 15 where the operation unit 75*a* is in the first position (see FIG. 10B). In this state, the cam 69*a* presses the spring holding member 67 downward. As a result, the spring 64 is pressed down to apply preset force to the separation roller holder 65. In this embodiment, the spring 64 has two lengths: "short" and "long" lengths.

Figure 11C:
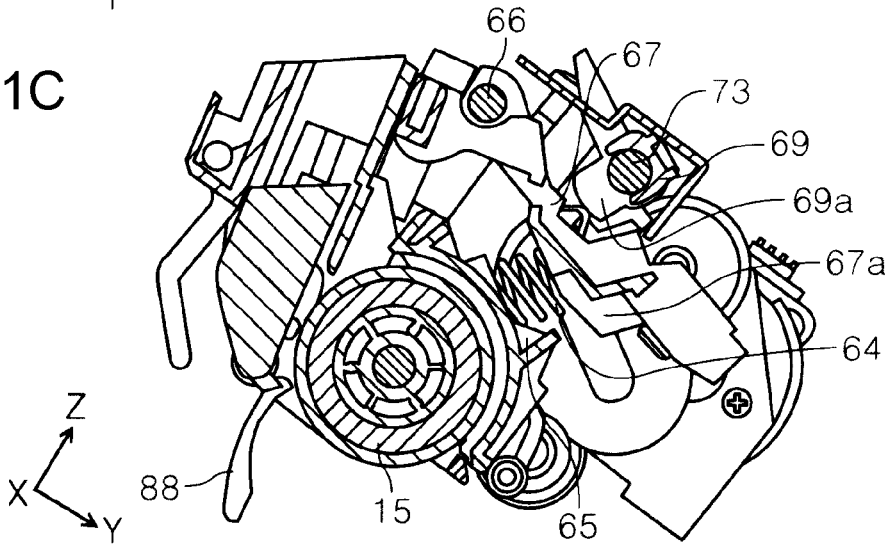
FIG. 11C is a cross-sectional view taken along the line XI-XI of FIG. 4 when the operation unit is in the third position.

FIG. 11C illustrates a state of the separation rollers 15 where the operation unit 75*a* is in the third position (see FIG. 10C). In this state, similar to the state of FIG. 11B, the cam 69*a* presses the spring holding member 67 downward so that the spring 64 has the short length. When the operation unit 75*a* is in the third position, the separation rollers 15 press the feed rollers 14 at substantially the same force as in the first position.

FIG. 11A illustrates a state of the separation rollers 15 where the operation unit 75*a* is in the second position (see FIG. 10A). In this state, the cam 69*a* presses the spring holding member 67 at lower force than any of those when the operation unit 75*a* is in the first and third positions. As a result, the spring 64 has a longer length than any of those in the other states, so that the separation rollers 15 press the feed rollers 14 at lower force. In which case, the separation rollers 15 less effectively separate sheets P. Hereinafter, the feeding of sheets P in the state of FIG. 11A is referred to as the "soft separation mode", and the feeding of sheets P in the state of FIG. 11B is referred to as the "normal separation mode".

In short, the operation unit 75*a* can be switched between the three positions: the first position as illustrated in FIG. 10B; the second position as illustrated in FIG. 10A; and the third position as illustrated in FIG. 10C. When the operation unit 75*a* is switched to the first position, the switching unit 55 (see FIGS. 12A and 12B) enters the first state where the driving power of the separation roller motor 51 is transmitted to the separation rollers 15, and the separation rollers 15 thereby operate in the separation mode and separate sheets P. This separation mode corresponds to the normal separation mode where the separation rollers 15 press the feed rollers 14 at normal force (see FIG. 11B). When the operation unit 75*a* is switched to the second position, the switching unit 55 (FIGS. 12A and 12B) enters the first state where the driving power of the separation roller motor 51 is transmitted to the separation rollers 15, and the separation rollers 15 thereby operate in the separation mode and separate sheets P. This separation mode corresponds to the soft separation mode where the separation rollers 15 press the feed rollers 14 at lower force than that in the normal separation mode (see FIG. 11A). When the operation unit 75*a* is switched to the third position, the switching unit 55 (see FIGS. 12A and 12B) enters the second state where the driving power of the separation roller motor 51 is not transmitted to the separation rollers 15, and the separation rollers 15 thereby operate in the non-separation mode and do not to separate sheets P. In this case, the separation rollers 15 presses the feed rollers 14 at substantially the same force as that in the above normal separation mode.

Next, a description will be given of suppression units 80*a* that suppress the front edges of sheets P from making contact with the separation rollers 15. In this embodiment, the lowermost one of the sheets P to be fed is in contact with the feed rollers 14. If the front edge of a sheet P mounted on the sheet mount 11 (see FIG. 2) is in contact with the outer circumferential surfaces of the separation rollers 15, the separation rollers 15 may press the feed rollers 14 in conjunction with deformation of their outer circumferential surfaces. As a result, this pressing force and the pressing force that the spring 64 (see FIGS. 11A to 11C) applies to the separation rollers 15 may be excessively applied to the feed rollers 14, thereby risking multi-feeding of the sheets P. In this embodiment, the suppression units 80*a* are provided to suppress the front edges of sheets P from making contact with the separation rollers 15.

As illustrated in FIGS. 6 to 8, a suppression member 80 is attached to a frame 79 so as to be slidable along the thickness of the sheets P, or along the Z-axis of the page of FIG. 6. In this embodiment, the suppression member 80 includes two suppression units 80*a*. The suppression member 80 is urged upward by a spring 81 as illustrated in FIGS. 7 and 8, namely, such that the suppression units 80*a* move away from the sheet feeding route. Furthermore, the suppression member 80 further includes a suppressed unit 80*b*, as illustrated in FIG. 6, that is suppressed by the cam member 69 from moving upward.

As described above, the cam member 69 is attached to the shaft 73 rotatable by the operation of the operation unit 75*a*. When the shaft 73 rotates, the cam member 69 presses the suppression member 80 downward. FIGS. 7 and 8 illustrate a process in which the cam member 69 presses the suppression member 80 downward. In this way, the combination of the cam member 69, the spring 81, and the shaft 73 constitute an operation converter that converts the movement of the operation unit 75*a* into the displacement of the suppression units 80*a*.

The positional relationship between the operation unit 75*a* and the suppression units 80*a* will be described below. When the operation unit 75*a* is in the first position (see FIG. 10B), the suppression units 80*a* are disposed at the highest position. In other words, the suppression units 80*a* are disposed at a high position in the normal separation mode. In this embodiment, the suppression units 80*a* are disposed at two positions: the high position and a low position. When the operation unit 75*a* is in the second position (see FIG. 10A), the suppression units 80*a* are disposed at the low position. In other words, the suppression units 80*a* are disposed at the low position in the soft separation mode. When the operation unit 75*a* is in the third position (see FIG. 10C), the suppression units 80*a* are disposed at the high position. In other words, the suppression units 80*a* are disposed at the high position in the non-separation mode.

Table 1 lists the relationships, as described above, between the position of the operation unit 75*a* and the separation mode

TABLE 1

| OPERATION UNIT | SEPARATION MODE | SEPARATION ROLLER | PRESS FORCE OF SEPARATION ROLLER | SUPPRESSION UNIT |
|---|---|---|---|---|
| First (center) position (neutral position) | Normal separation | Driving power transmitted | Strong | High |
| Second (rear) position | Soft separation | Driving power transmitted | Weak | Low |
| Third (front) position | Non-separation | No driving power transmitted | Strong | High |

Figure 9A:
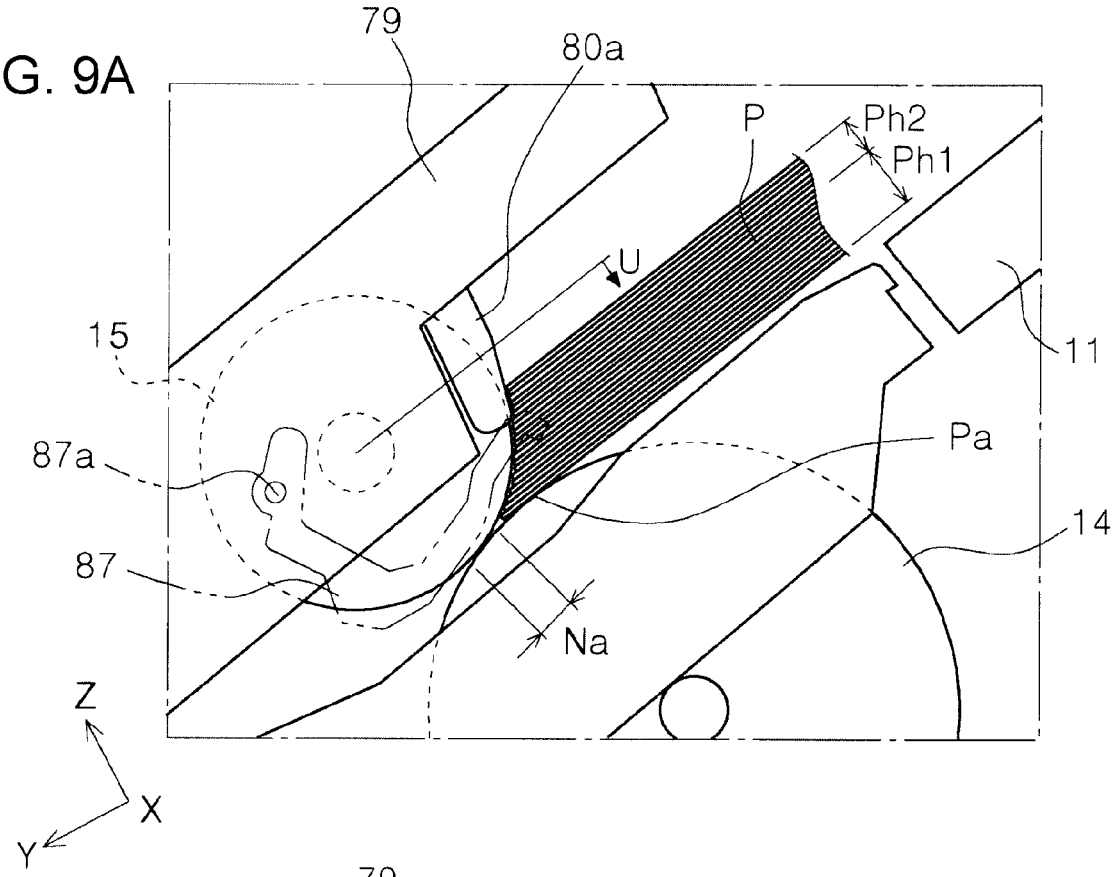
FIG. 9A is a side view of the suppression units disposed at a high position.
Figure 9B:
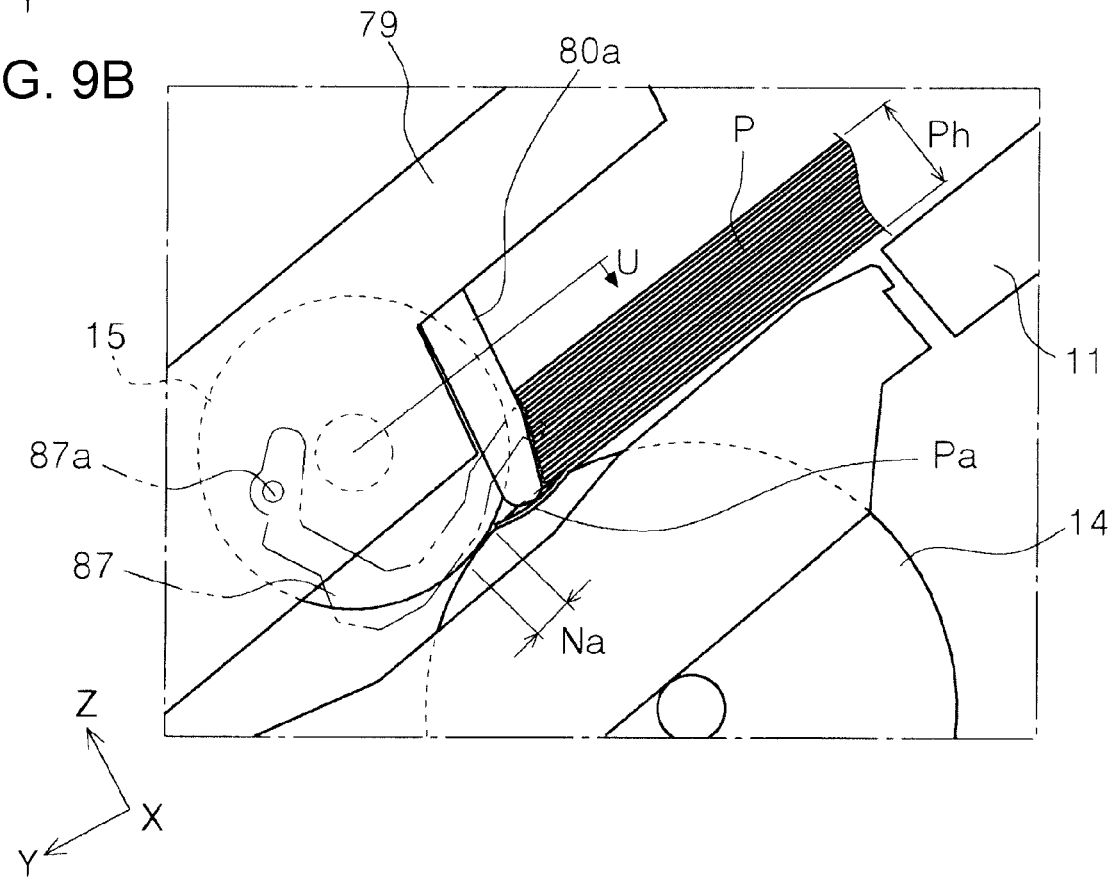
FIG. 9B is a side view of the suppression units disposed at a low position.

With reference to FIGS. 9A and 9B, a function of the suppression units 80*a* will be described below. When the suppression units 80*a* are disposed at the high position, the front edges of sheets P mounted on the sheet mount 11 make contact with the outer circumferential surface of the separation rollers 15, as illustrated in FIG. 9A. In this case, the outer circumferential surfaces of the separation rollers 15 are deformed, and this deformation causes the sheets P to press the separation rollers 15 against the feed rollers 14. As a result, the separation rollers 15 may excessively press the feed rollers 14, thereby causing multi-feeding of the sheets P. It should be noted that, when the front edges of the sheets P fall within a range U below the rotation center of the separation rollers 15, the sheets P is more likely to make contact with the separation rollers 15 to press the separation rollers 15 against the feed rollers 14.

To address the above disadvantage, the suppression units 80*a* are provided. The suppression units 80*a* are designed to control the number of sheets P in contact with the outer circumferential surfaces of the separation rollers 15. In FIGS. 9A and 9B, a nip region Na is present between the separation rollers 15 and the feed rollers 14. In this embodiment, the suppression units 80*a* are disposed upstream of the nip region Na and spaced along the width of the sheets P as illustrated in FIGS. 6 and 7. The suppression units 80*a* make contact with the front edges of sheets P other than at least a lowermost sheet Pa, thereby suppressing the front edges from making contact with the separation rollers 15. In this way, it is possible to suppress the separation rollers 15 from excessively pressing the feed rollers 14, thereby reducing the risk of the multi-feeding of the sheets P.

Among sheets available from the market, thinner sheets tend to have a greater coefficient of friction therebetween. Sheets P having a smaller thickness, therefore, are more likely to cause multi-feeding. For this reason, if each sheet P has a small thickness, the operation unit 75*a* (e.g., see FIGS. 1 and 4) is switched to the second position, thereby setting the separation mode to the soft separation mode. As a result, the suppression units 80*a* are disposed at the low position as illustrated in FIG. 9B so that most of the sheets P do not make contact with the separation rollers 15. In this way, it is possible to reduce the risk of the multi-feeding of the sheets P. In this state, the ends of the suppression units 80*a* overlap the feed rollers 14 as seen from the side of the feeding route. Even in this case, however, at least the lower most sheet P can reach the nip region Na between the feed rollers 14 and the separation rollers 15, because the feed rollers 14 can be deformed as illustrated in FIG. 9B, and the lower most sheet P having a small thickness can pass under the suppression units 80*a*. In this soft separation mode, the front portions of the sheets P are less likely to be curled up despite their small thickness, because the separation rollers 15 press the feed rollers 14 at weak force.

If each sheet P has a large thickness, the operation unit 75*a* (e.g., see FIGS. 1 and 4) is switched to the first position, thereby setting the separation mode to the normal separation mode. As a result, the suppression units 80*a* are disposed at the high position as illustrated in FIG. 9A so that, of sheets P, upper sheets Ph2 do not make contact with the separation rollers 15 but lower sheets Ph1 make contact with the separation rollers 15. In this way, it is possible to reduce the risk of the multi-feeding of the sheets P. In this state, the ends of the suppression units 80*a* do not overlap the feed rollers 14 as seen from the side of the feeding route.

If many sheets P such as pages of a booklet are transported inside the sheet feeding apparatus 1B, the sheets P may be stuck when separated by the separation rollers 15. In this case, the operation unit 75*a* (e.g., see FIGS. 1 and 4) is switched to the third position, thereby setting the separation mode to the non-separation mode. As a result, the separation rollers 15 disables the function of separating the sheets P, thereby reducing the risk of the sheets P being stuck even when many sheets P, such as pages of a booklet, are transported.

Next, a description will be given of other features of the configuration of the sheet feeding apparatus 1B. As illustrated in FIG. 5, a stiffening member 87 is disposed between the first separation roller 15A and the second separation roller 15B along the width of a sheet P. As illustrated in FIG. 9B, the stiffening member 87 is pivotable around the pivot shaft 87*a* and urged by an unillustrated spring, which is an example of the presser, toward the sheet feeding route. The stiffening member 87 configured in this manner causes a sheet P to be warped in a wavy fashion along its width. This warped sheet P becomes stiffer in the feeding direction and thus is less likely to be stuck. Moreover, as illustrated in FIG. 5, set guides 88 are disposed upstream of the suppression units 80*a* when a sheet P is not transported. The set guides 88 suppresses the sheet P from being shifted to the downstream side when a sheet P is mounted on the sheet mount 11. When the sheet P is transported, the set guides 88 are displaced away from the feeding route by an unillustrated mechanism.

Figure 13B:
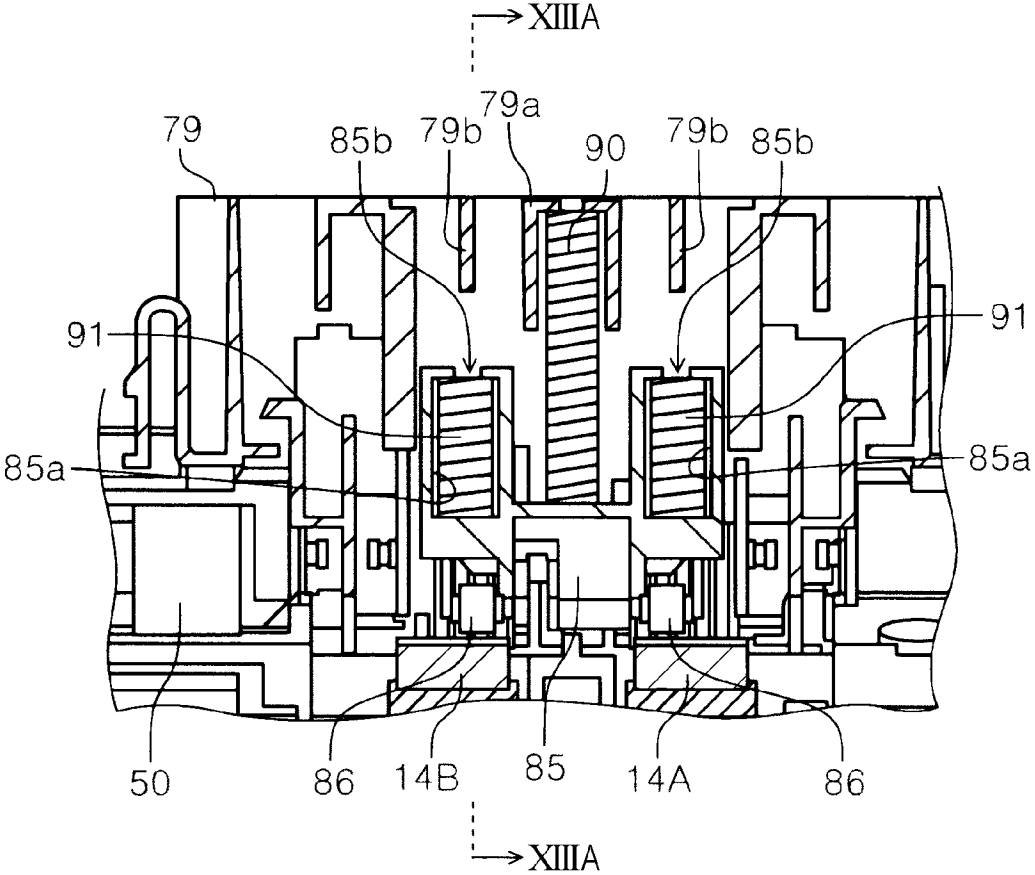
FIG. 13B illustrates a configuration of the pressing member in which a first pressing spring is pressed down and second pressing springs are pulled out.
Figure 14B:
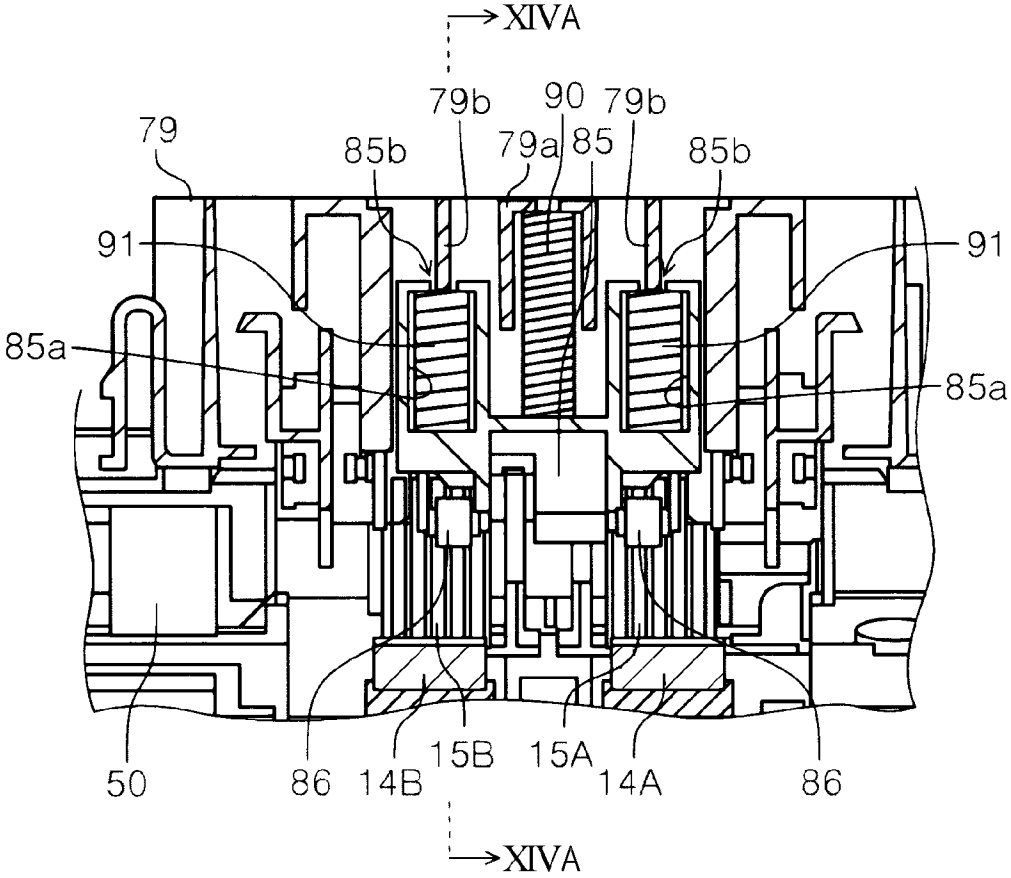
FIG. 14B illustrates another configuration of the pressing member in which the first and second pressing springs are pressed down.
Figure 15B:
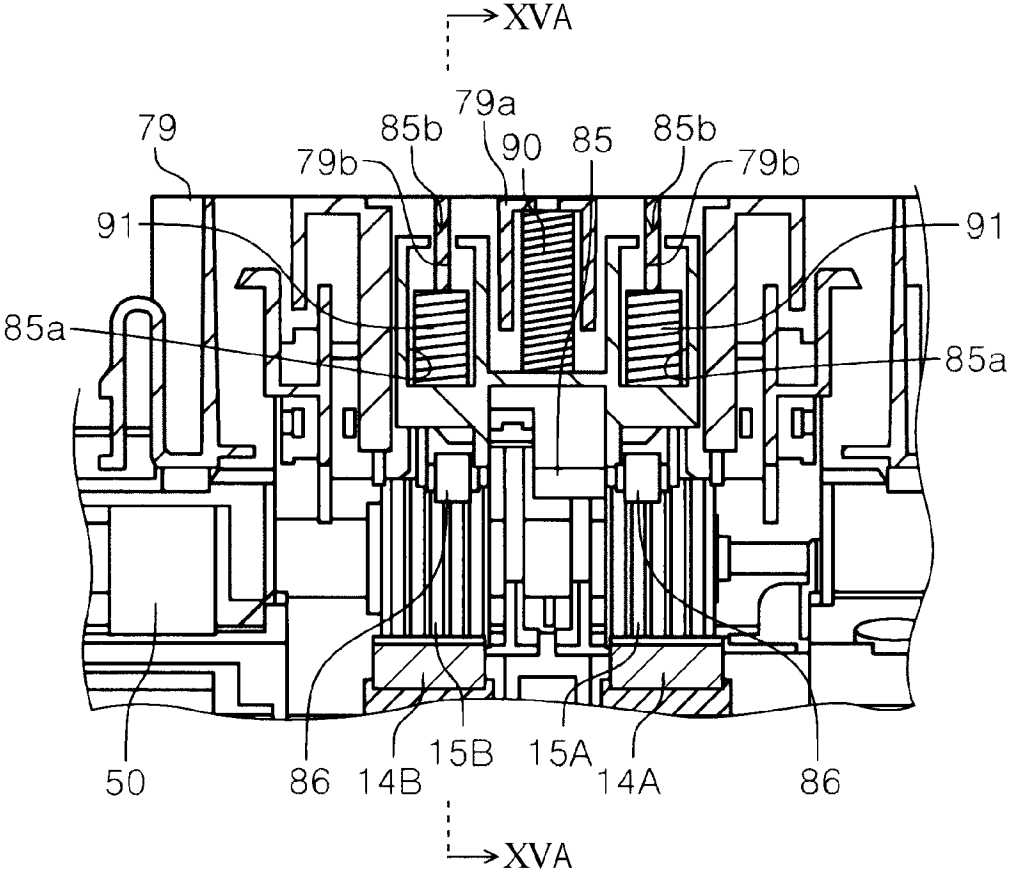
FIG. 15B illustrates still another configuration of the pressing member in which the first and second pressing springs are pressed down.

Disposed above and near the front edge of a sheet P mounted in the sheet mount 11 is a pressing member 85, which serves as a nip member. The pressing member 85 is movable toward or away from the feed rollers 14 and urged toward a sheet P by the presser, which will be described later, so as to press a front or surrounding portion of the sheet P mounted in the sheet mount 11. The pressing member 85 nips the sheet P together with the feed rollers 14, as illustrated in FIGS. 13B, 14B, and 15B. Disposed at the position where the pressing member 85 makes contact with the sheet P is a driven roller 86. The driven roller 86 is designed to reduce a load on the sheet P especially when a single sheet P is transported.

As illustrated in FIGS. 13A to 15B, the pressing member 85 is slidable relative to a frame 79 along the thickness of sheets P, or Z-axis. The pressing member 85 is urged by two types of springs having different lengths: a first pressing spring 90 and two second pressing springs 91. In this embodiment, the first pressing spring 90 and the second pressing springs 91 constitute the presser. The first pressing spring 90 exerts spring force between a spring abutment unit 79*a* disposed in the frame 79 and the pressing member 85. Likewise, the second pressing springs 91 exert spring force between spring abutment units 79*b* disposed in the frame 79 and the pressing member 85. The second pressing springs 91 are accommodated in respective spring holders 85*a* in the pressing member 85. When the spring abutment units 79*b* are inserted into the spring holders 85*a* via apertures 85*b* formed in upper portions of the spring holders 85*a*, the second pressing springs 91 exert the spring force between the spring abutment units 79*b* and the pressing member 85.

Figure 13A:
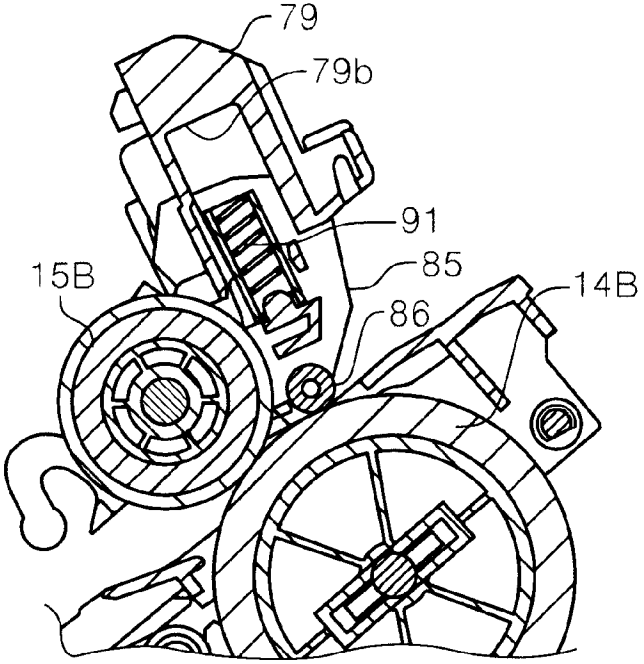
FIG. 13A is a cross-sectional view taken along the line XIIIA-XIIIA of FIG. 13B.
Figure 14A:
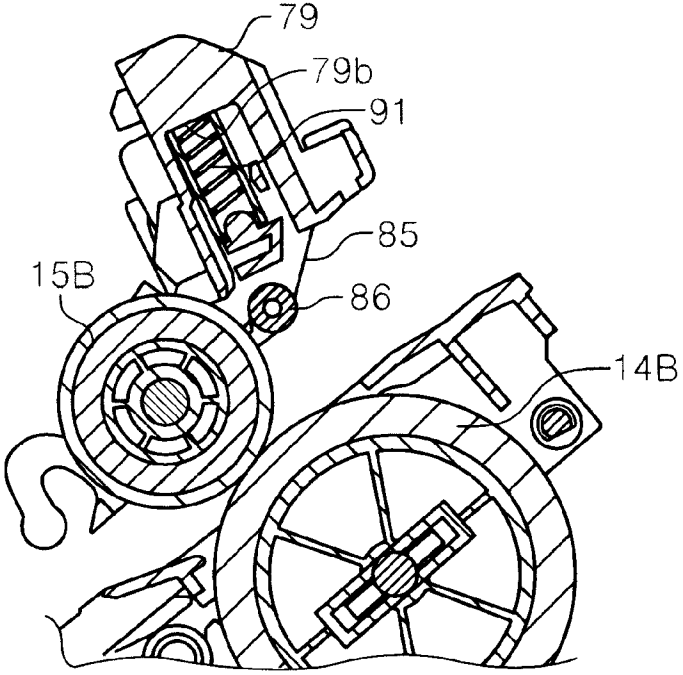
FIG. 14A is a cross-sectional view taken along the line XIVA-XIVA of FIG. 14B.
Figure 15A:
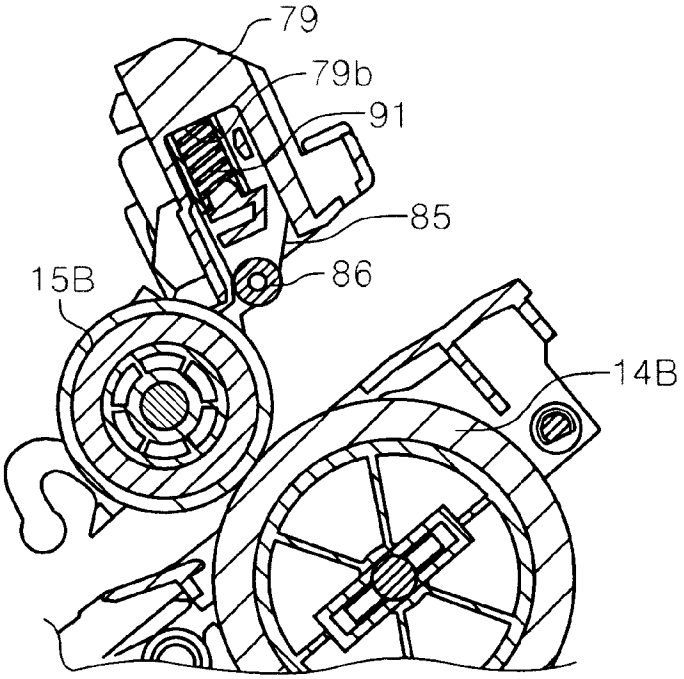
FIG. 15A is a cross-sectional view taken along the line XVA-XVA of FIG. 15B.

If a few sheets P are mounted in the sheet mount 11, more specifically, if the total thickness of the sheets P is smaller than a preset thickness, the spring abutment units 79*b* are not inserted into the spring holders 85*a* via the apertures 85*b*, as illustrated in FIG. 13B. In this case, the pressing member 85 receives the spring force only from the first pressing spring 90. If many sheets P are mounted in the sheet mount 11, the spring abutment units 79*b* are slightly inserted into the spring holders 85*a* via the apertures 85*b*, as illustrated in FIG. 14B. If many more sheets P are mounted in the sheet mount 11, the spring abutment units 79*b* are deeply inserted into the spring holders 85*a* via the apertures 85*b*, as illustrated in FIG. 15B, in which case the second pressing springs 91 sufficiently exert the spring force. It should be noted that FIG. 13A is a cross-sectional view taken along the line XIIIA-XIIIA of FIG. 13B; FIG. 14A is a cross-sectional view taken along the line XIVA-XIVA of FIG. 14B; and FIG. 15A is a cross-sectional view taken along the line XVA-XVA of FIG. 15B.

Effects of the pressing member 85 configured above will be described below. When the sheet feeding apparatus 1B fails to transport sheets P appropriately, the following disadvantages may be arise: some of the sheets P are stuck inside; and some of the sheets P are not ejected to the outside. The multi-feeding of the sheets P may be caused by, for example, a low friction between the separation rollers 15 and the sheets P, a low torque of the separation rollers 15, or a high friction between the sheets P which is attributed to excessively pressing of the pressing member 85. The failure to eject sheets P may be caused by, for example, a low friction between the feed rollers 14 and the lowermost sheet P or a low friction between the sheet mount 11 and the lowermost sheet P. In short, it is necessary to comprehensively consider such factors in order to suppress both the multi-feeding of sheets P and the failure to eject sheets P. Moreover, in this embodiment, the pressing force of the pressing member 85 and the number, or the total thickness, of sheets P mounted are believed to be related to the above disadvantages. More specifically, when a few sheets P are mounted, the pressing member 85 may press the sheet P excessively, thereby causing the multi-feeding of the sheets P. When many sheets P are mounted, the pressing member 85 may press the sheet P insufficiently, thereby causing the failure to eject the sheets P.

To address the above disadvantages, in this embodiment, the pressing member 85 is disposed. When a few sheets P are mounted in the sheet mount 11, only the first pressing spring 90 exerts the spring force on the sheets P. When many sheets P are mounted, not only the first pressing spring 90 but also the second pressing springs 91 exert the spring force to the sheets P. In this way, the pressing member 85 can suppress the multi-feeding of the sheets P when many sheets P are mounted and can also suppress the failure to eject the sheets P when a few sheets P are mounted.

Next, with reference to FIGS. 16 to 18, a description will be given of a method of controlling the feeding of sheets P. As illustrated in FIGS. 17A to 17C, the first sheet detector 31 (see FIG. 2) detects a sheet P1 fed along the sheet feeding route at a first sheet detection point 31*s*, and the second sheet detector 32 (see FIG. 2) detects a sheet P fed along the sheet feeding route at a second sheet detection point 32*s*.

Figure 16:
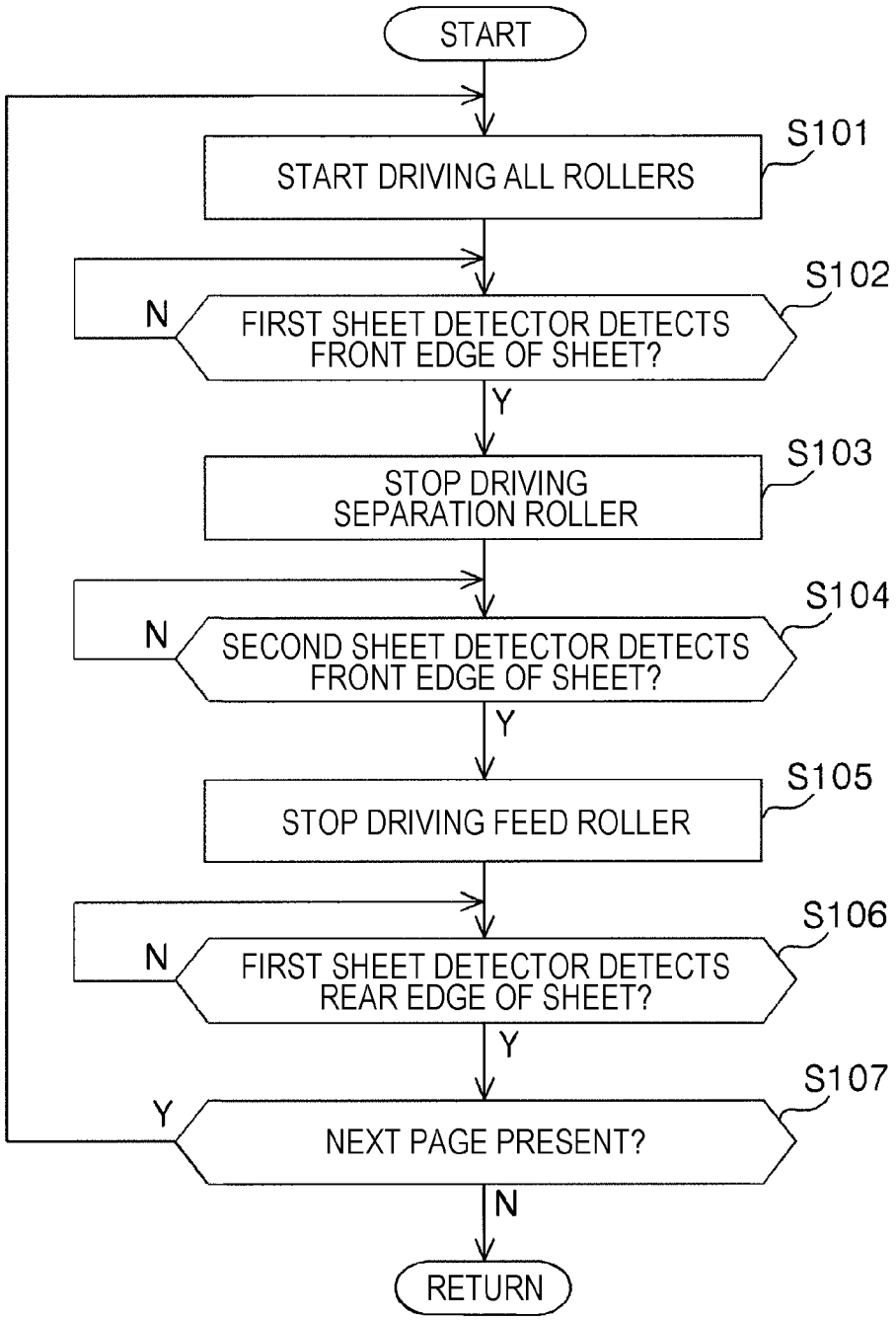
FIG. 16 is a flowchart of a method of controlling the feeding of sheets.
Figure 17A:
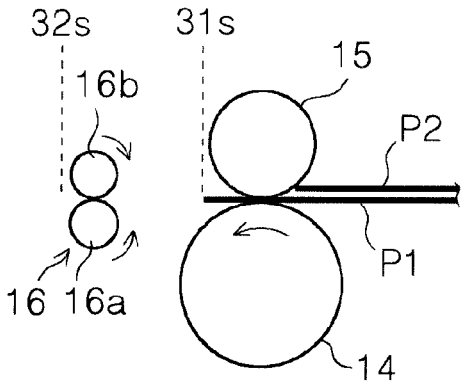
FIG. 17A illustrates a process of the control method in which sheets are being fed by the feed rollers and the separation rollers.
Figure 17B:
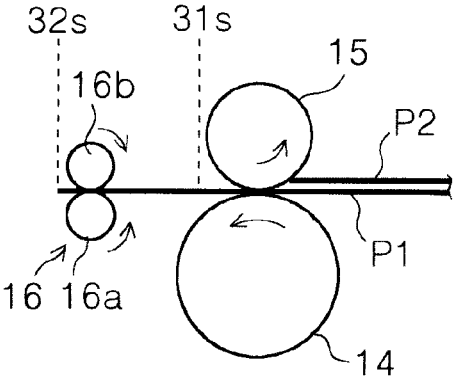
FIG. 17B illustrates another process of the control method in which the sheets are being fed by the feed rollers and the separation rollers.
Figure 17C:
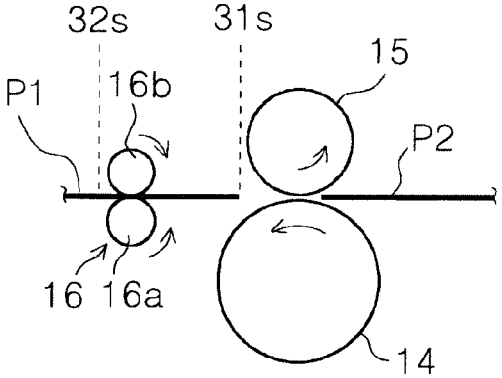
FIG. 17C illustrates still another process of the control method in which the sheets are being fed by the feed rollers and the separation rollers.
Figure 18:
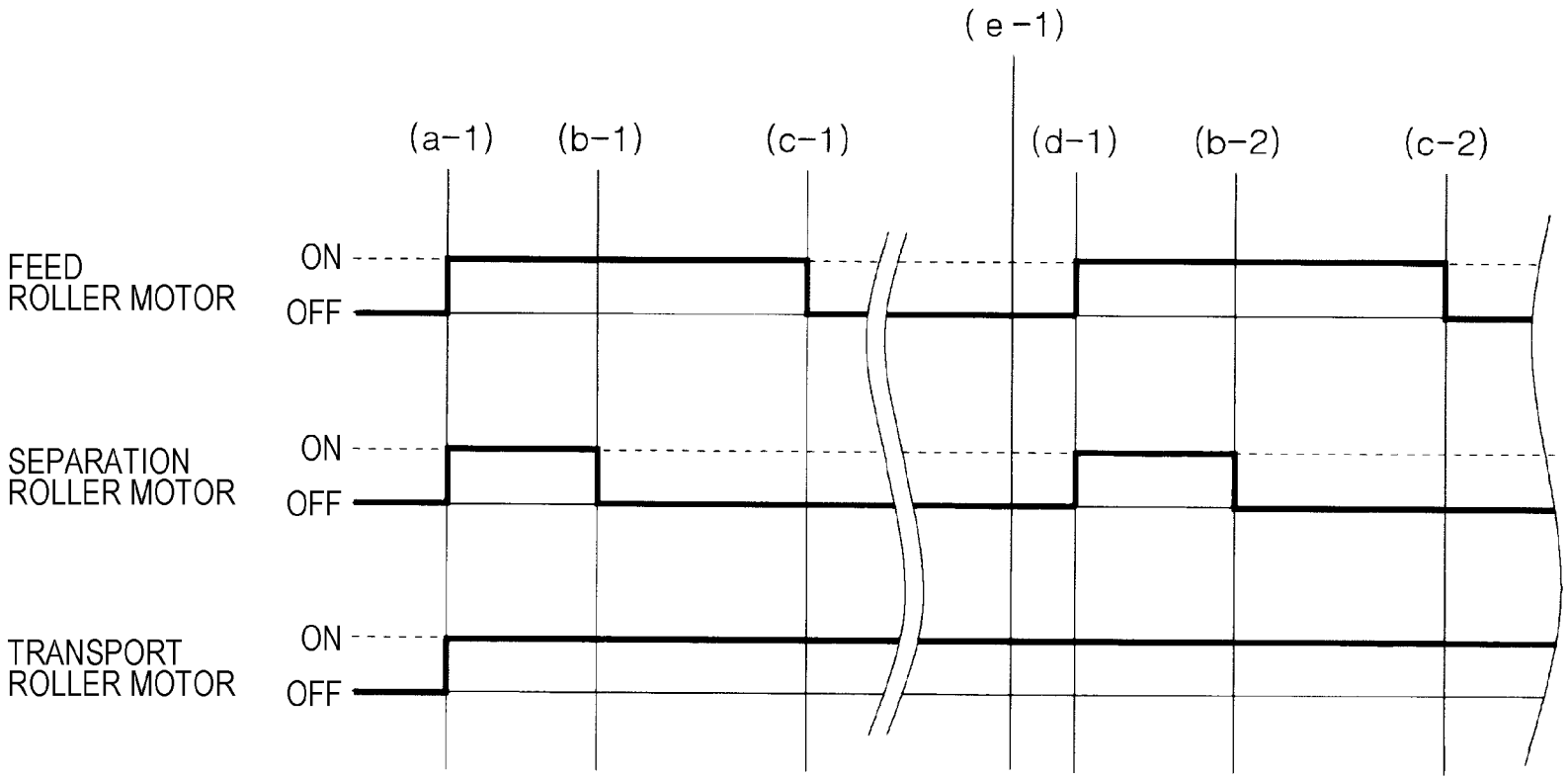
FIG. 18 is a timing chart of the control method.

As illustrated in FIG. 16, at Step S101, in response to the reception of an instruction of transporting sheets P, the controller 40 (see FIG. 3) drives the feed roller motor 45, the transport roller motor 46, and the separation roller motor 51 to start rotating the feed rollers 14, the separation rollers 15, and the transport roller pair 16 (at timing a-1 in FIG. 18).

At Step S102, the controller 40 determines whether the first sheet detector 31 has detected the front edge of a first sheet P1. When the first sheet detector 31 has detected the front edge of the first sheet P1 (Yes at Step S102), at Step S103, the controller 40 stops driving the separation rollers 15 (at timing b-1 in FIG. 18). In FIG. 17A, the front edge of the first sheet P1 reaches the first sheet detection point 31*s* of the first sheet detector 31.

At Step S104, the controller 40 determines whether the second sheet detector 32 has detected the front edge of the first sheet P1. When the second sheet detector 32 has detected the front edge of the first sheet P1 (Yes at Step S104), at Step S105, the controller 40 stops driving the feed rollers 14 (at timing c-1 in FIG. 18). In FIG. 17B, the front edge of the first sheet P1 reaches the second sheet detection point 32*s* of the second sheet detector 32.

At Step S106, the controller 40 determines whether the first sheet detector 31 has detected the rear edge of the first sheet P1. When the first sheet detector 31 has detected the rear edge of the first sheet P1 (Yes at Step S106), at Step S107, the controller 40 determines whether the next page, or a second sheet P2, is present. When the second sheet P2 is present (Yes at Step S107), the controller 40 repeats the control at the above steps S101 to S107 (at timing d-1 in FIG. 18). In FIG. 18, timings (b-2) and (c-2) are timings at which the controller 40 controls the feeding of the second sheet P2. In FIG. 17C, the rear edge of the first sheet P1 reaches the first sheet detection point 31*s* of the first sheet detector 31.

The duration of the period between timings c-1 and d-1 may vary depending on the length of the sheets P. This period contains timing e-1 at which the rear edge of the first sheet P1 leaves the nip position between the feed rollers 14 and the separation rollers 15.

Effects of the above control will be described below. If the controller 40 does not perform this control, the separation rollers 15 continue to apply driving torque to the separation rollers 15 in the reverse rotation direction. In this case, when the rear edge of the first sheet P1 leaves the nip position between the separation rollers 15 and the feed rollers 14, the opposite force generated by the kickback phenomenon and the opposite force generated by the reverse rotation of the separation rollers 15 are applied at one time to the front edge of the second sheet P2 on the separation rollers 15. As a result, a front portion of the second sheet P2 may be curled up. With this control, however, a break period in which the separation roller motor 51 stops rotating is reserved during an operation of feeding the first sheet P1 and the second sheet P2 (Step S103 in FIG. 16). This break period contains a timing (timing e-1 in FIG. 18) at which the rear edge of the first sheet P1 leaves the nip position between the feed rollers 14 and the separation rollers 15. Thus, when the rear edge of the sheet P1 leaves the nip position, the opposite force generated by the kickback phenomenon is applied to the front edge of the second sheet P2 on the separation rollers 15 but the opposite force generated by the reverse rotation of the separation rollers 15 is not applied thereto. As a result, the front portion of sheet P2 is less likely to be curled up. In this embodiment, the controller 40 switches between the above break period and a drive period in which the separation roller motor 51 is driven.

Figure 19:
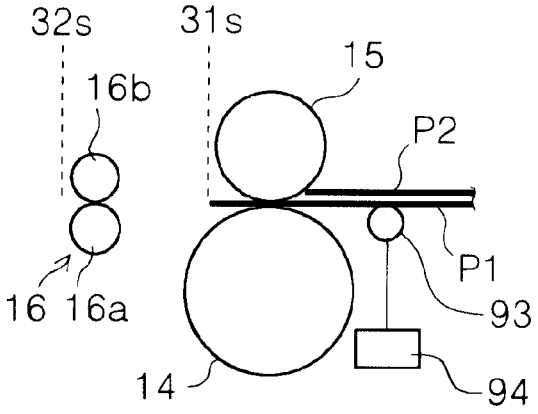
FIG. 19 illustrates an upstream detector disposed upstream of the feed rollers and the separation rollers.

Next, a modification of the above control will be described below. The first sheet detector 31, which is disposed downstream of the nip position between the feed rollers 14 and the separation rollers 15, serves as a downstream detector, and an upstream detector is newly disposed upstream of the nip position to detect the passage of a sheet P. As illustrated in FIG. 19, for example, the upstream detector may include: a driven roller 93; and a rotary encoder 94 that detects the rotation of the driven roller 93. As long as the rotary encoder 94 detects the rotation of the driven roller 93, the controller 40 determines that a sheet P is being fed to the downstream side. When the rotary encoder 94 stops detecting the rotation of the driven roller 93, the controller 40 determines that the rear edge of the sheet P has passed the driven roller 93. The controller 40 may set the break period in which the separation rollers 15 stop rotating to the interval between when the rotary encoder 94 detects the passage of the rear edge of the sheet P1 and when the first sheet detector 31 disposed downstream of the nip position detects the passage of the rear edge of the sheet P1. In this way, the controller 40 can reliably reserve a timing at which the rear edge of the sheet P1 leaves the nip position within the break period.

As another modification, the controller 40 may calculate the time interval between when the rotary encoder 94 detects the passage of the rear edge of the sheet P1 and when the rear edge of the sheet P1 leaves the nip position for the downstream side, based on the distance between the driven roller 93 and the nip position and the transport speed of sheets P. After the rotary encoder 94 has detected the passage of the rear edge of the sheet P1, the controller 40 may set the break period to a period containing the calculated time interval. In this way, the controller 40 can also reliably reserve a timing at which the rear edge of the sheet P1 leaves the nip position within the break period.

Figure 20:
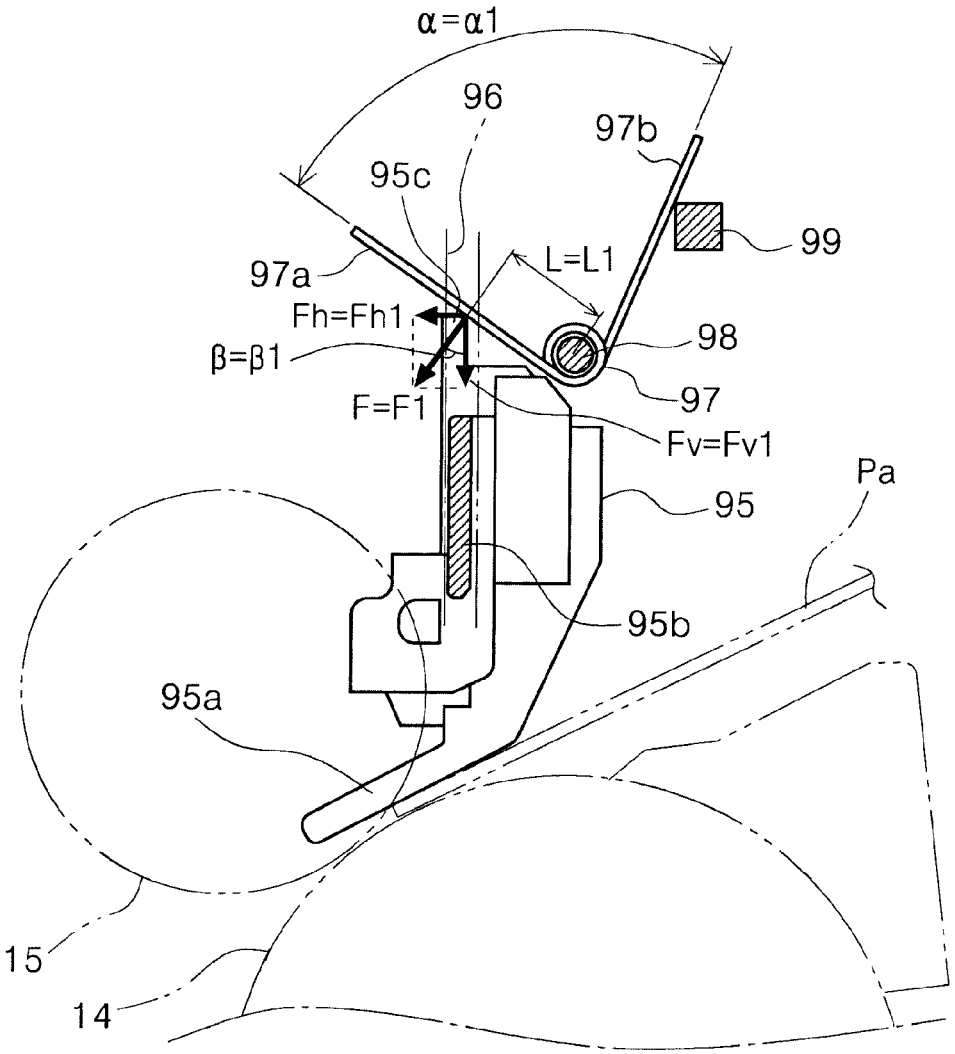
FIG. 20 illustrates a presser in a sheet feeding apparatus according to another embodiment of the present disclosure; the presser presses a pressing member.
Figure 21:
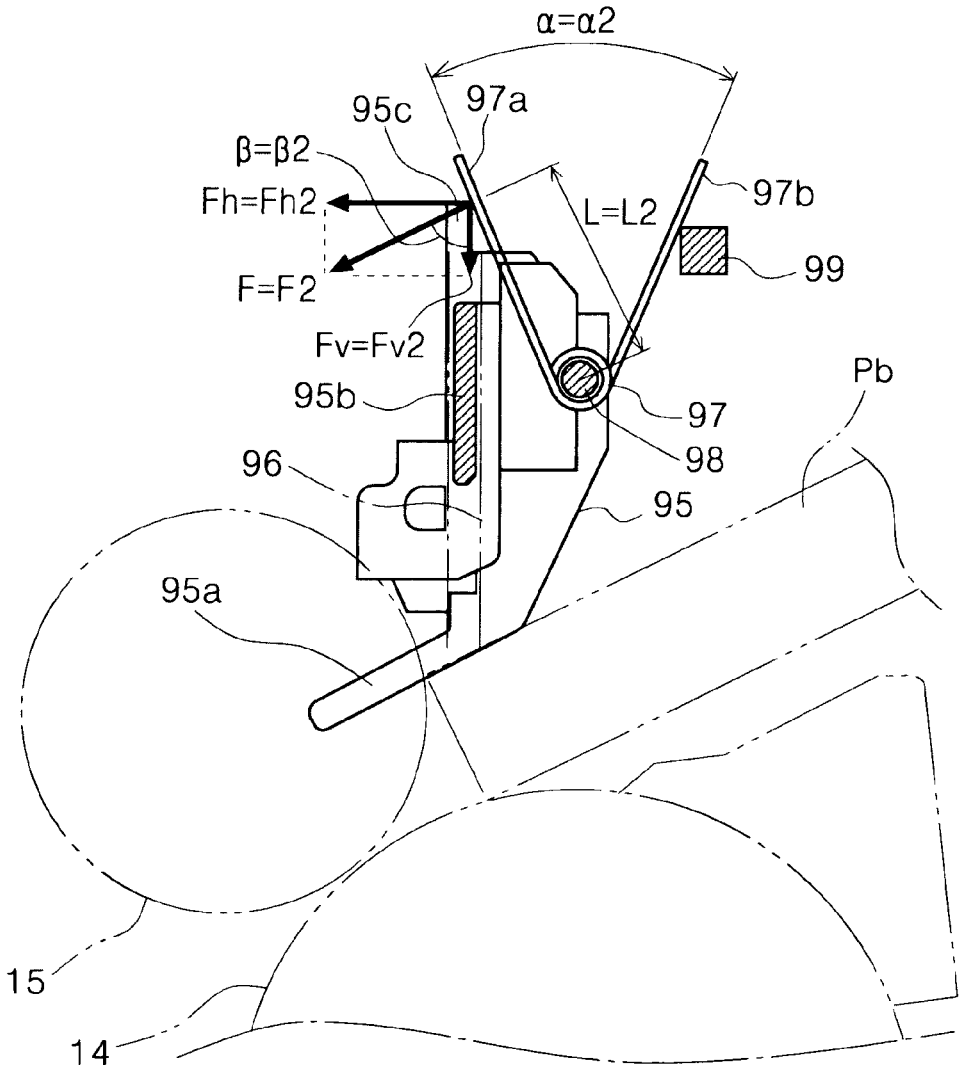
FIG. 21 illustrates the presser in the sheet feeding apparatus according to the another embodiment; the presser presses the pressing member.

Next, with reference to FIGS. 20 to 22, a description will be given of a presser in a sheet feeding apparatus 1B according to another embodiment; the presser presses a pressing member as illustrated in FIGS. 13B, 14B, and 15B. As illustrated in FIGS. 20 and 21, a pressing member 95 includes: a pressing unit 95*a* that presses a sheet P; and a guided unit 95*b* movable toward or away from the feed rollers 14. The guided unit 95*b* is guided by a guide unit 96.

In this embodiment, the presser that presses the pressing member 95 against the feed rollers 14 includes a torsion spring 97 accommodated in a spring holder 98. The torsion spring 97 includes a first arm 97*a* and a second arm 97*b*. The first arm 97*a* applies spring force to the pressing member 95, whereas the second arm 97*b* abuts against a spring abutment unit 99 fixed in place. Both the first arm 97*a* and the second arm 97*b* exert the spring force in directions in which they move away from each other.

In FIG. 20, a minimum number of sheets P, namely, a single sheet Pa is mounted in the sheet mount 11. In this case, the thickness of the sheet Pa corresponds to the minimum total thickness of the sheets P. In FIG. 21, a maximum number of sheets Pb are mounted in the sheet mount 11. In this case, the total thickness of the sheets Pb corresponds to the maximum total thickness of the sheets P. In general, each of the minimum and maximum total thicknesses depends on the thickness of each sheet P. Furthermore, the maximum total thickness also depends on a configuration of the sheet feeding apparatus 1B. In this embodiment, the minimum thickness corresponds to the thickness of the thinnest type of a sheet supported by the sheet feeding apparatus 1B.

The first arm 97*a* of the torsion spring 97 applies the spring force F to a pressed unit 95*c* of the pressing member 95. When the sheet Pa is mounted, as illustrated in FIG. 20, a distance L between a point at which the first arm 97*a* makes contact with the pressed unit 95*c* and the center of the torsion spring 97 becomes a distance L1, or the shortest distance. An angle $\alpha$ between the first arm 97*a* and the second arm 97*b* becomes an angle $\alpha$1, or the greatest angle. In this case, the spring force F that the first arm 97*a* applies to the pressed unit 95*c* becomes spring force F1. The spring force F1 can be divided into components of force Fv=Fv1 and Fh=Fh1: the component of force Fv=Fv1 exerts in a first direction, which is a direction in which the pressing member 95 moves toward the feed rollers 14; and the component of force Fh=Fh1 exerts in a second direction, which is a direction orthogonal to the first direction. In short, the component of force Fv=Fv1 corresponds to the pressing force that the pressing member 95 applies to the feed rollers 14, in other words, the pressing force that pressing member 95 applies to the sheet Pa against the feed rollers 14. An angle $\beta=\beta 1$ corresponds to an angle between the spring force F1 and the component of force Fv=Fv1. The angle $\beta=\beta 1$ becomes minimum when a minimum number of sheets P are mounted.

When the sheet Pb is mounted, as illustrated in FIG. 21, the distance L between the point at which the first arm 97*a* makes contact with the pressed unit 95*c* and the center of the torsion spring 97 becomes a distance L2, or the longest distance. The angle $\alpha$ between the first arm 97*a* and the second arm 97*b* becomes an angle $\alpha 2$, or the smallest angle. In this case, the spring force F becomes spring force F2. The spring force F2 can be divided into components of force Fv=Fv2 and Fh=Fh2: the component of force Fv=Fv2 exerts in the first direction in which the pressing member 95 moves toward the feed rollers 14; and the component of force Fh=Fh2 exerts in the second direction orthogonal to the first direction. Thus, the component of force Fv=Fv2 corresponds to the pressing force that the pressing member 95 applies to the feed rollers 14, in other words, the pressing force that pressing member 95 applies to the sheet Pb against the feed rollers 14. An angle $\beta=\beta 2$ corresponds to an angle between the spring force F2 and the component of force Fv=Fv2. The angle $\beta=\beta 2$ becomes maximum when the total thickness of sheets P becomes maximum.

As the total thickness of sheets P increases, the angle $\alpha$ between the first arm 97*a* and the second arm 97*b* in the torsion spring 97 decreases, and thus the spring force F that the torsion spring 97 applies to the sheets P increases. This leads to an increase in the component of force Fv contained in the spring force F.

As the total thickness of sheets P increases, the angle $\beta$ between the direction in which the first arm 97*a* applies the spring force F to the pressing member 95 and the direction in which the pressing member 95 moves toward the feed rollers 14 increases. In this case, a direction in which the spring force F is applied to the sheets P differs more from a direction in which the pressing member 95 moves toward the feed rollers 14. This leads to a decrease in the component of force Fv.

As the total thickness of sheets P increases, the distance L between the point at which the first arm 97*a* makes contact with the pressed unit 95*c* and the center of the torsion spring 97 increases. This leads to a decrease in the component of force Fv.

As described above, when the total thickness of sheets P varies, the angle α between the first arm 97*a* and the second arm 97*b*, the angle β between the direction in which the first arm 97*a* applies the spring force F to the pressing member 95 and the direction in which the pressing member 95 moves toward the feed rollers 14, and the distance L between the point at which the first arm 97*a* applies the spring force F to the pressing member 95 and the center of the torsion spring 97 vary. In short, the force at which the pressing member 95 presses a sheet P against the feed rollers 14, namely, the component of force Fv does not absolutely depend on the number of sheets P. Consequently, it is possible to flexibly set the force at which the pressing member 95 presses a sheet P against the feed rollers 14, namely, the component of force Fv, thereby successfully optimizing a condition in which sheets P are fed.

By changing the design and position of the torsion spring 97, the relationship between the total thickness of sheets P and the component of force Fv can be adjusted. More specifically, the relationship between the total thickness of the sheets P and the component of force Fv can be adjusted, for example, by changing angles α1, α2, β1, and β2, and the distances L1 and L2, an inclination of the torsion spring 97, the number of times that the torsion spring 97 is twisted, a diameter of the torsion spring 97, and a material and diameter of a wire of the torsion spring 97 and by selecting which of forces generated when the torsion spring 97 is pulled out and pushed down is to be used.

Figure 22:
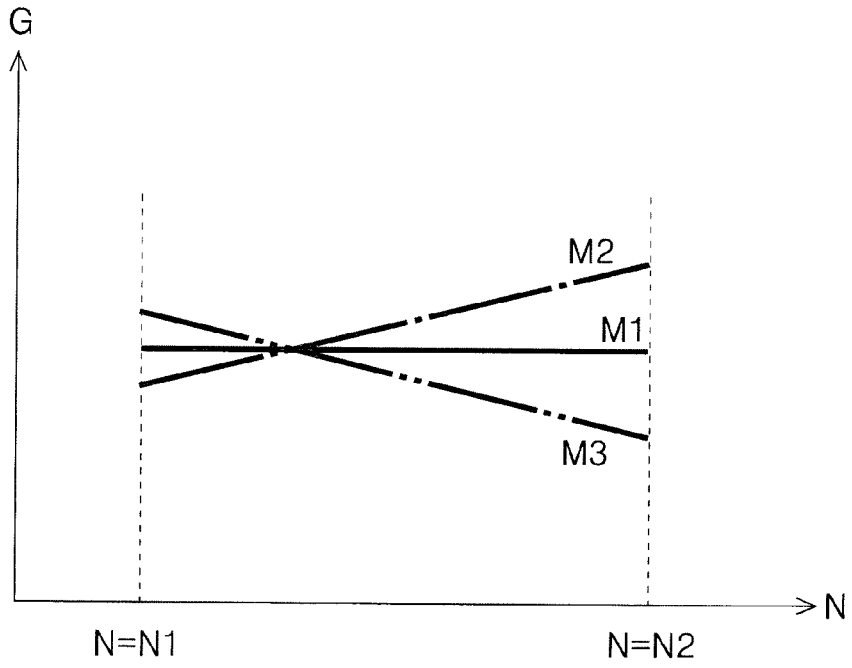
FIG. 22 is an example of a graph indicating the relationship between the total thickness of sheets and a load placed on the lowermost sheet on the feed rollers.

FIG. 22 is an example of a graph indicating the relationship between the total thickness of sheets and a load placed on the lowermost sheet on the feed rollers. In this graph, the horizontal axis N represents the total thickness of sheets P, and the vertical axis G represents a load on the lowermost sheet P in contact with the feed rollers 14. The mark N1 indicates a point at which the total thickness of the sheets P becomes minimum, and the mark N2 indicates at a point at which the total thickness of the sheets P becomes maximum. The load on the lowermost sheet is equivalent to the sum of the component of force Fv and the total weight load of the sheets P. The straight line M1, expressed by a solid line, indicates that the load is constant independently of the total thickness of the sheets P. The straight line M2, expressed by an alternate long and short dash line, indicates that the load increases with an increase in the total thickness of the sheets P. The straight line M3, expressed by an alternate long and short dash line, indicates that the load decreases with an increase in the total thickness of the sheets P. If the presser is made of a simple coil spring, it may be difficult to adjust the load in the above manner. However, providing the torsion spring 97 as in this embodiment can achieve flexible load adjustment. In the embodiment illustrated in FIGS. 20 and 21, the relationship between the total thickness of the sheets P and the load is expressed by the straight line M3. The total weight of the sheets P depends on a fiber density of each sheet P, more specifically, a basis weight of each sheet P if it is made of paper. Therefore, the relationship between the total thickness of sheets P and the load is preferably set, based on a possibility that the multi-feeding of the sheet P or failure to feed the sheets P occurs or which of the multi-feeding of the sheet P and failure to feed the sheets P is more likely to occur.

In the foregoing embodiments, a medium feeding apparatus according to the present disclosure is applied to a scanner, which is an example of an image reading apparatus. The medium feeding apparatus is, however, also applicable to a recording apparatus with a recording head, such as a printer, by which information is to be stored in a medium.

What is claimed is:

1. A medium feeding apparatus comprising:

a feed roller that feeds a plurality of media and makes contact with a lowermost medium of the media mounted in a medium mount where media to be fed are mounted and rotates to feed the lowermost medium;

a separation roller that nips the media together with the feed roller to separate the media and that is rotated in a first rotation direction to feed the media to a downstream side in a feeding direction;

a plurality of suppression units that suppress front edges of the media from making contact with the separation roller by making contact with the front edges of the media other than at least the lowermost medium, the suppression units being disposed upstream of the nip position, the suppression units being spaced along a width of the media in a direction intersecting the feeding direction;

a motor that applies driving torque to the separation roller in a second rotation direction that is opposite to the first rotation direction;

a torque limiter that, when rotation torque applied to the separation roller in the first rotation direction exceeds a preset upper torque limit, causes the separation roller to rotate at idle in the first rotation direction, independently of the driving torque;

a plurality of detectors that detect passage of the media, the detectors being disposed downstream of a nip position between the feed roller and the separation roller in the feeding direction;

a nip member that nips the media mounted in the medium mount together with the feed roller, the nip member being movable toward or away from the feed roller;

a presser that presses the nip member against the feed roller; and a controller that controls the motor, wherein during a feeding operation in which a first medium and a second medium are fed in this order, the controller switches between a drive period in which the motor is driven and a break period in which the motor is not driven, based on detection results of the plurality of detectors, the break period containing a timing at which a rear edge of the first medium leaves the nip position, the presser includes a first spring that presses the nip member against the feed roller and a second spring that presses the nip member against the feed roller, when a total thickness of the media mounted in the medium mount is smaller than a preset thickness, the first spring exerts spring force on the nip member but the second spring does not exert spring force on the nip member, and when the total thickness of the media mounted in the medium mount is equal to or larger than the preset thickness, the first spring exerts the spring force on the nip member and the second spring also exerts the spring force on the nip member.

2. The medium feeding apparatus according to claim 1, further comprising:

a first detector that detects the passage of the media, the first detector being disposed downstream of the nip position in the feeding direction;

a transport roller that feeds the media to the downstream side, the transport roller being disposed downstream of the first detector in the feeding direction; and a second detector that detects the passage of the media, the second detector being disposed downstream of the transport roller in the feeding direction, wherein the plurality of detectors include the first detector and the second detector, and the controller sets the break period to a period containing a time interval between when the second detector detects passage of a front edge of the first medium and when the first detector detects passage of the rear edge of the first medium.

3. An image reading apparatus comprising:

a reader that reads the media; and the medium feeding apparatus according to claim 1 which feeds the media to the reader.

4. The medium feeding apparatus according to claim 1, further comprising;

an operation unit to be operated by a user; and an operation converter that converts movement of the operation unit into displacement of the suppression units, wherein the suppression units are arranged on both sides of the separation roller along the width of the media in the direction intersecting the feeding direction and are displaceable along a thickness of the media.

5. The medium feeding apparatus according to claim 4, wherein the operation unit configured to be switched between a first position, a second position, and a third position, the medium feeding apparatus further comprises a switching unit that switches between a first state in which driving power of the motor is transmitted to the separation roller and a second state in which the driving power of the motor is not transmitted to the separation roller, when the operation unit is in the first position, ends of the suppression units do not overlap the feed roller as seen from a side of a feeding route of the media and the switching unit is in the first state, when the operation unit is in the second position, the ends of the suppression units overlap the feed roller as seen from the side of the feeding route of the media and the switching unit is in the first state, and when the operation unit is in the third position, the ends of the suppression units do not overlap the feed roller as seen from the side of the feeding route of the media and the switching unit is in the second state.

6. The medium feeding apparatus according to claim 4, wherein the operation unit is operably disposed on an exterior of a housing.

7. A medium feeding apparatus comprising:

a feed roller that feeds a plurality of media and makes contact with a lowermost medium of the media mounted in a medium mount where media to be fed are mounted and rotates to feed the lowermost medium;

a separation roller that nips the media together with the feed roller to separate the media and that is rotated in a first rotation direction to feed the media to a downstream side in a feeding direction;

a plurality of suppression units that suppress front edges of the media from making contact with the separation roller by making contact with the front edges of the media other than at least the lowermost medium, the suppression units being disposed upstream of the nip position, the suppression units being spaced along a width of the media in a direction intersecting the feeding direction;

a motor that applies driving torque to the separation roller in a second rotation direction that is opposite to the first rotation direction;

a torque limiter that, when rotation torque applied to the separation roller in the first rotation direction exceeds a preset upper torque limit, causes the separation roller to rotate at idle in the first rotation direction, independently of the driving torque;

a plurality of detectors that detect passage of the media, the detectors being disposed downstream of a nip position between the feed roller and the separation roller in the feeding direction;

a nip member that nips the media mounted in the medium mount together with the feed roller, the nip member movable toward or away from the feed roller; and a presser that presses the nip member against the feed roller; and a controller that controls the motor, wherein during a feeding operation in which a first medium and a second medium are fed in this order, the controller switches between a drive period in which the motor is driven and a break period in which the motor is not driven, based on detection results of the plurality of detectors, the break period containing a timing at which a rear edge of the first medium leaves the nip position, the presser has a torsion spring that presses the nip member against the feed roller, the torsion spring includes a first arm that applies spring force of the torsion spring to the nip member and a second arm that abuts against a spring abutment unit fixed in place, and when the total thickness of the media mounted in the medium mount varies, an angle between the first arm and the second arm, an angle between a direction in which the first arm exerts the spring force on the nip member and a direction in which the nip member moves to the feed roller, and a distance between a point at which the first arm exerts the spring force on the nip member and a center of the torsion spring vary.

8. The medium feeding apparatus according to claim 7, further comprising;

an operation unit to be operated by a user; and an operation converter that converts movement of the operation unit into displacement of the suppression units, wherein the suppression units are arranged on both sides of the separation roller along the width of the media in the direction intersecting the feeding direction and are displaceable along a thickness of the media.

9. The medium feeding apparatus according to claim 7, further comprising:

a first detector that detects the passage of the media, the first detector being disposed downstream of the nip position in the feeding direction;

a transport roller that feeds the media to the downstream side, the transport roller being disposed downstream of the first detector in the feeding direction; and a second detector that detects the passage of the media, the second detector being disposed downstream of the transport roller in the feeding direction, wherein the plurality of detectors include the first detector and the second detector, and the controller sets the break period to a period containing a time interval between when the second detector detects passage of a front edge of the first medium and when the first detector detects passage of the rear edge of the first medium.

10. The medium feeding apparatus according to claim 8, wherein the operation unit configured to be switched between a first position, a second position, and a third position, the medium feeding apparatus further comprises a switching unit that switches between a first state in which driving power of the motor is transmitted to the separation roller and a second state in which the driving power of the motor is not transmitted to the separation roller, when the operation unit is in the first position, ends of the suppression units do not overlap the feed roller as seen from a side of a feeding route of the media and the switching unit is in the first state, when the operation unit is in the second position, the ends of the suppression units overlap the feed roller as seen from the side of the feeding route of the media and the switching unit is in the first state, and when the operation unit is in the third position, the ends of the suppression units do not overlap the feed roller as seen from the side of the feeding route of the media and the switching unit is in the second state.

11. The medium feeding apparatus according to claim 8, wherein the operation unit is operably disposed on an exterior of a housing.

12. An image reading apparatus comprising:

a reader that reads the media; and the medium feeding apparatus according to claim 7 which feeds the media to the reader.

* * * * *